US011334019B2

(12) United States Patent
Yamaguchi

(10) Patent No.: US 11,334,019 B2
(45) Date of Patent: May 17, 2022

(54) IMAGE FORMING APPARATUS INCLUDING CAM CONFIGURED TO MOVE DEVELOPMENT ROLLER

(71) Applicant: BROTHER KOGYO KABUSHIKI KAISHA, Nagoya (JP)

(72) Inventor: Wataru Yamaguchi, Nisshin (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/306,207

(22) Filed: May 3, 2021

(65) Prior Publication Data

US 2021/0349420 A1 Nov. 11, 2021

(30) Foreign Application Priority Data

May 7, 2020 (JP) ..... JP2020-081684

(51) Int. Cl.

| | |
|---|---|
| ***G03G 21/16*** | (2006.01) |
| ***G03G 15/00*** | (2006.01) |
| ***G03G 15/08*** | (2006.01) |
| ***G03G 21/18*** | (2006.01) |

(52) U.S. Cl.

CPC ..... *G03G 21/1619* (2013.01); *G03G 15/0896* (2013.01); *G03G 21/1647* (2013.01); *G03G 21/1676* (2013.01); *G03G 21/1821* (2013.01)

(58) Field of Classification Search

CPC ..... G03G 21/1619; G03G 21/1647; G03G 21/1676; G03G 2221/163; G03G 2221/1647; G03G 15/0896; G03G 21/1821

See application file for complete search history.

(56) References Cited

U.S. PATENT DOCUMENTS

| | | | | |
|---|---|---|---|---|
| 2007/0077086 | A1* | 4/2007 | Takakuwa ..... | G03G 21/1676 399/111 |
| 2009/0304412 | A1 | 12/2009 | Hattori et al. | |
| 2020/0310279 | A1* | 10/2020 | Itabashi ..... | G03G 21/1676 |
| 2020/0310291 | A1* | 10/2020 | Itabashi ..... | G03G 21/1676 |
| 2021/0011395 | A1* | 1/2021 | Itabashi ..... | G03G 21/1647 |

FOREIGN PATENT DOCUMENTS

JP 2009-162904 A 7/2009

* cited by examiner

*Primary Examiner* — Sophia S Chen
(74) *Attorney, Agent, or Firm* — Merchant & Gould P.C.

(57) ABSTRACT

A first cam moves between: a first position at which the first cam causes a development frame to be located at a contact position; and a second position at which the first cam causes the development frame to be located at a separation position. A second cam moves between: a third position at which the second cam, in cooperation with the first cam, causes the development frame to be located at the contact position in a state where the first cam is located at the first position; and a fourth position at which the second cam, in cooperation with the first cam, causes the development frame to be located at the separation position in a state where the first cam is located at the second position. The first cam is located at a higher position than the second cam in a vertical direction.

14 Claims, 15 Drawing Sheets

IMAGE FORMING APPARATUS INCLUDING CAM CONFIGURED TO MOVE DEVELOPMENT ROLLER

CROSS REFERENCE TO RELATED APPLICATIONS

This application claims priority from Japanese Patent Application No. 2020-081684 filed May 7, 2020. The entire content of the priority application is incorporated herein by reference.

TECHNICAL FIELD

This disclosure relates to an image forming apparatus.

BACKGROUND

Conventionally, an image forming apparatus includes a photosensitive drum, a development frame, a first cam, and a second cam. The photosensitive drum extends in a first direction. The development frame supports a development roller. The development frame is movable between a contact position and a separation position. The development roller and the photosensitive drum contact each other in a state where the development frame is located at the contact position. The development roller is separated from the photosensitive drum in a state where the development frame is located at the separation position. The second cam is located at the opposite side of the first cam with respect to the development frame in the first direction. The first cam is movable between a first position and a second position. The second cam is movable between a third position and a fourth position. In a state where the first cam is located at the first position and the second cam is located at the third position, the first cam and the second cam cause the development frame to be located at the contact position. In a state where the first cam is located at the second position and the second cam is located at the fourth position, the first cam and the second cam cause the development frame to be located at the separation position. The first cam and the second cam are located at the same position in the vertical direction.

SUMMARY

According to one aspect, this specification discloses an image forming apparatus. The image forming apparatus includes a drum frame, a development frame, a first cam, and a second cam. The drum frame supports a photosensitive drum rotatable about a rotation axis extending in a first direction. The development frame supports a development roller. The development frame is movable between a contact position at which the development roller contacts the photosensitive drum and a separation position at which the development roller is separated from the photosensitive drum. The first cam is movable between: a first position at which the first cam causes the development frame to be located at the contact position; and a second position at which the first cam causes the development frame to be located at the separation position. The second cam is located at an opposite side of the first cam with respect to the development frame in the first direction. The second cam is movable between: a third position at which the second cam, in cooperation with the first cam, causes the development frame to be located at the contact position in a state where the first cam is located at the first position; and a fourth position at which the second cam, in cooperation with the first cam, causes the development frame to be located at the separation position in a state where the first cam is located at the second position. The first cam is located at a higher position than the second cam in a vertical direction.

According to another aspect, this specification also discloses an image forming apparatus. The image forming apparatus includes a drum frame, a development frame, a first cam, and a second cam. The drum frame supports a photosensitive drum rotatable about a rotation axis extending in a first direction. The development frame supports a development roller, the development frame being movable between a contact position at which the development roller contacts the photosensitive drum and a separation position at which the development roller is separated from the photosensitive drum. The first cam is configured to move the development frame between the contact position and the separate position. The second cam is located at an opposite side of the first cam with respect to the development frame in the first direction. The second cam is configured to move the development frame between the contact position and the separate position in cooperation with the first cam. The first cam is located at a higher position than the second cam in a vertical direction.

BRIEF DESCRIPTION OF THE DRAWINGS

Embodiments in accordance with this disclosure will be described in detail with reference to the following figures wherein.

DETAILED DESCRIPTION

It is desired to further reduce the size of the image forming apparatus. However, if the size of the image forming apparatus is reduced, it may not be possible to secure sufficient space for arranging the first cam and the second cam.

In view of the foregoing, an aspect of an objective of this disclosure is to provide an image forming apparatus in which the first cam and the second cam can be arranged, while reducing the size of the apparatus.

1. Image Forming Apparatus 1

An image forming apparatus 1 will be described with reference to FIG. 1.

Figure 1:
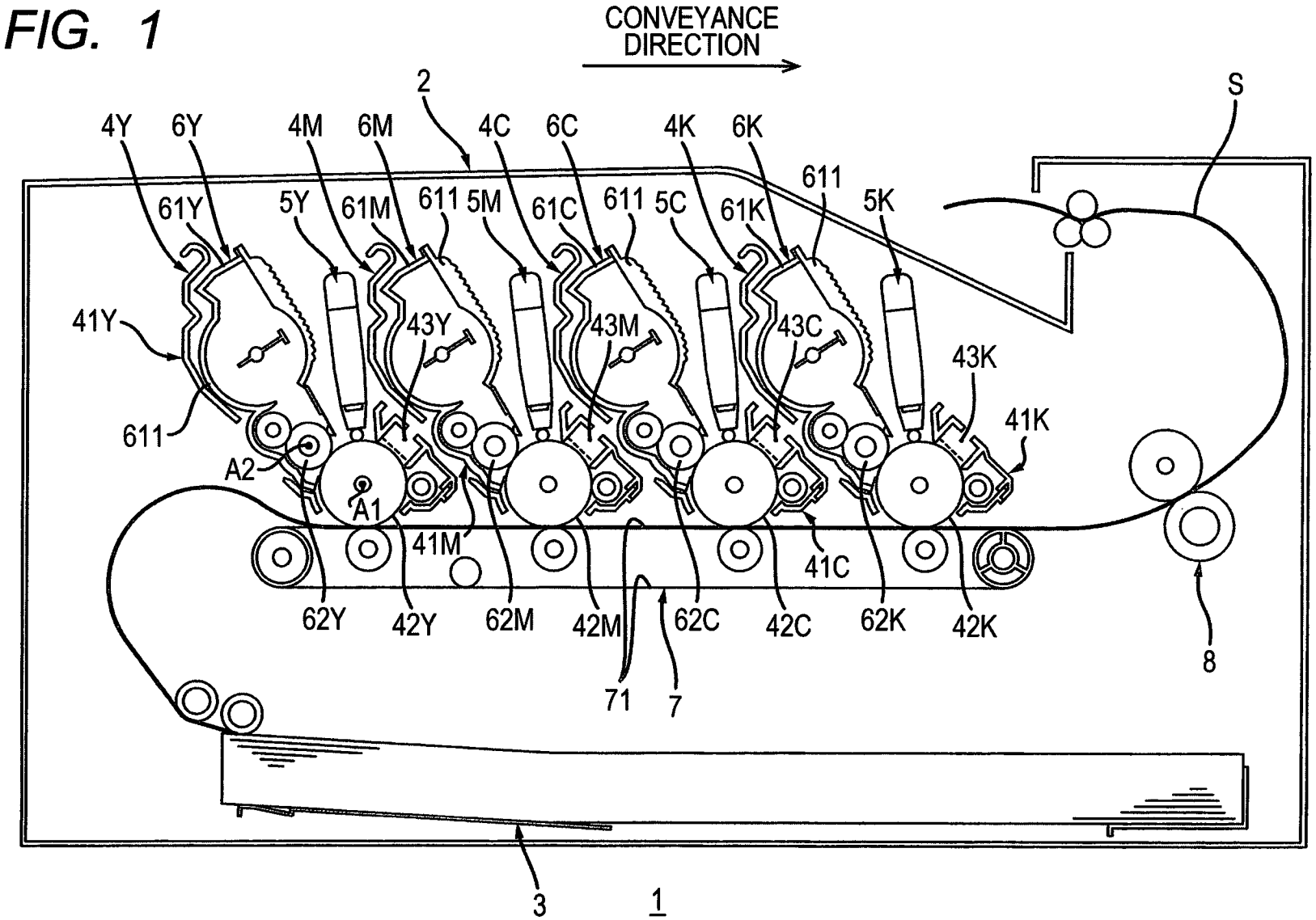
FIG. 1 is a schematic diagram showing the configuration of an image forming apparatus.

As shown in FIG. 1, the image forming apparatus 1 includes a housing 2, a sheet cassette 3, four drum units 4Y, 4M, 4C, 4K, four exposure devices 5Y, 5M, 5C, 5K, four development units 6Y, 6M, 6C, 6K, a transfer device 7, and a fixing device 8.

1.1 Housing 2

The housing 2 accommodates the sheet cassette 3, the four drum units 4Y, 4M, 4C, 4K, the four exposure devices 5Y, 5M, 5C, 5K, the four development units 6Y, 6M, 6C, 6K, the transfer device 7, and the fixing device 8.

1.2 Sheet Cassette 3

The sheet cassette 3 is configured to accommodate a sheet S. The sheet S in the sheet cassette 3 is conveyed toward the drum unit 4Y.

1.3 Four Drum Units 4Y, 4M, 4C, 4K

The four drum units 4Y, 4M, 4C, and 4K are arranged in a conveyance direction of the sheet S in which the sheet S is conveyed by a conveyance belt 71. The conveyance belt 71 will be described later. The four drum units 4Y, 4M, 4C, and 4K are arranged in the order of the drum unit 4Y, the drum unit 4M, the drum unit 4C, and the drum unit 4K in the conveyance direction. Each of the four drum units 4Y, 4M, 4C, and 4K may be attachable to and detachable from the housing 2.

1.3.1 Drum unit 4Y

The drum unit 4Y includes a drum frame 41Y, a photosensitive drum 42Y, and a charger 43Y.

The drum frame 41Y supports the photosensitive drum 42Y and the charger 43Y.

The photosensitive drum 42Y extends in a first direction. The first direction intersects the conveyance direction and the vertical direction. The photosensitive drum 42Y has a cylindrical shape. The photosensitive drum 42Y is rotatable about a rotation axis A1. The rotation axis A1 extends in the first direction.

The charger 43Y charges the circumferential surface of the photosensitive drum 42Y. Specifically, the charger 43Y is a scorotron type charger. The charger 43Y may be a charging roller.

1.3.2 Drum Units 4M, 4C, 4K

The drum units 4M, 4C, and 4K will be described in the same manner as the drum unit 4Y. Thus, the description of the drum units 4M, 4C, and 4K will be omitted.

The drum unit 4M includes a drum frame 41M, a photosensitive drum 42M, and a charger 43M. The drum unit 4C includes a drum frame 41C, a photosensitive drum 42C, and a charger 43C. The drum unit 4K includes a drum frame 41K, a photosensitive drum 42K, and a charger 43K.

In other words, the image forming apparatus 1 includes the four drum frames 41Y, 41M, 41C, 41K, the four photosensitive drums 42Y, 42M, 42C, 42K, and the four chargers 43Y, 43M, 43C, 43K.

1.4 Four Exposure Devices 5Y, 5M, 5C, and 5K

The exposure device 5Y is configured to expose the surface of the photosensitive drum 42Y. When the exposure device 5Y exposes the surface of the photosensitive drum 42Y in a state where the surface of the photosensitive drum 42Y is charged, an electrostatic latent image is formed on the surface of the photosensitive drum 42Y. Specifically, the exposure device 5Y is an LED array.

The exposure devices 5M, 5C, and 5K are described in the same manner as the exposure device 5Y. Thus, the description of the exposure devices 5M, 5C, and 5K will be omitted. The exposure device 5M is configured to expose the surface of the photosensitive drum 42M. The exposure device 5C is configured to expose the surface of the photosensitive drum 42C. The exposure device 5K is configured to expose the surface of the photosensitive drum 42K.

1.5 Four Development Units 6Y, 6M, 6C, 6K

The development unit 6Y includes a development frame 61Y and a development roller 62Y. The development frame 61Y is configured to accommodate toner. The development frame 61Y supports the development roller 62Y. The development frame 61Y is attachable to and detachable from the drum frame 41Y. Thus, the development frame 61Y supporting the development roller 62Y and the drum frame 41Y supporting the photosensitive drum 42Y can be exchanged individually.

Figure 2A:
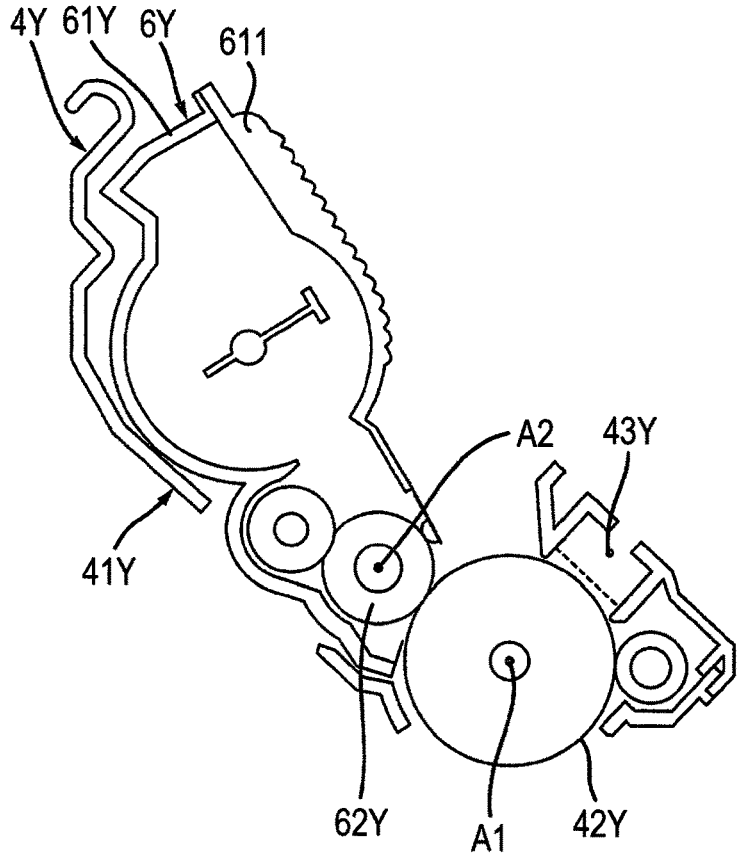
FIG. 2A is a schematic diagram showing the configuration of a drum unit and a development unit shown in FIG. 1, and showing a state where the development unit is located at a contact position.
Figure 2B:
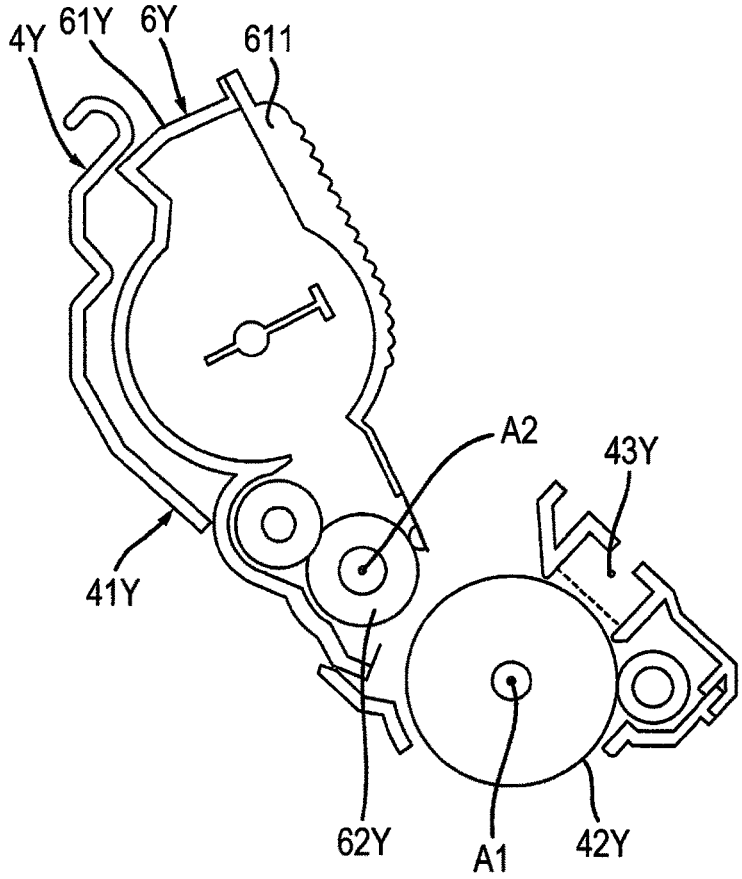
FIG. 2B is a schematic diagram showing the configuration of the drum unit and the development unit shown in FIG. 1, and showing a state where the development unit is located at a separation position.

As shown in FIGS. 2A and 2B, in a state where the development frame 61Y is attached to the drum frame 41Y, the development frame 61Y is movable between a contact position (see FIG. 2A) and a separation position (see FIG. 2B). In a state where the development frame 61Y is located at the contact position, the development roller 62Y contacts the photosensitive drum 42Y (see FIG. 2A). In a state where the development frame 61Y is located at the separation position, the development roller 62Y is separated from the photosensitive drum 42Y (see FIG. 2B).

In a state where the development frame 61Y is located at the contact position, the development roller 62Y supplies toner to the photosensitive drum 42Y. The development roller 62Y extends in the first direction. The development roller 62Y is rotatable about a rotation axis A2. The rotation axis A2 extends in the first direction.

The development units 6M, 6C, 6K are described in the same manner as the development unit 6Y. Thus, the description of the development units 6M, 6C, and 6K will be omitted.

As shown in FIG. 1, the development unit 6M includes a development frame 61M and a development roller 62M. The development roller 62M supplies toner to the photosensitive drum 42M. The development unit 6C includes a development frame 61C and a development roller 62C. The development roller 62C supplies toner to the photosensitive drum 42C. The development unit 6K includes a development frame 61K and a development roller 62K. The development roller 62K supplies toner to the photosensitive drum 42K. In other words, the image forming apparatus 1 includes the four development frames 61Y, 61M, 61C, 61K and the four development rollers 62Y, 62M, 62C, 62K.

1.6 Transfer Device 7

The transfer device 7 includes the conveyance belt 71. The conveyance belt 71 conveys the sheet S supplied from the sheet cassette 3 toward the fixing device 8. The sheet S conveyed by the conveyance belt 71 passes between the transfer device 7 and the four photosensitive drums 42Y, 42M, 42C, and 42K. At this time, the transfer device 7 transfers the toner on the four photosensitive drums 42Y, 42M, 42C, and 42K to the sheet S.

1.7 Fixing Device 8

The fixing device 8 heats and presses the sheet S on which the toner is transferred to fix the toner on the sheet S. The sheet S that has passed through the fixing device 8 is discharged to the upper surface of the housing 2.

2. Details of Drum Unit 4Y

Next, details of the drum unit 4Y will be described with reference to FIGS. 3 to 6. The drum units 4M, 4C, and 4K will be described in the same manner as the drum unit 4Y. Thus, the description of the drum units 4M, 4C, and 4K will be omitted.

Figure 4:
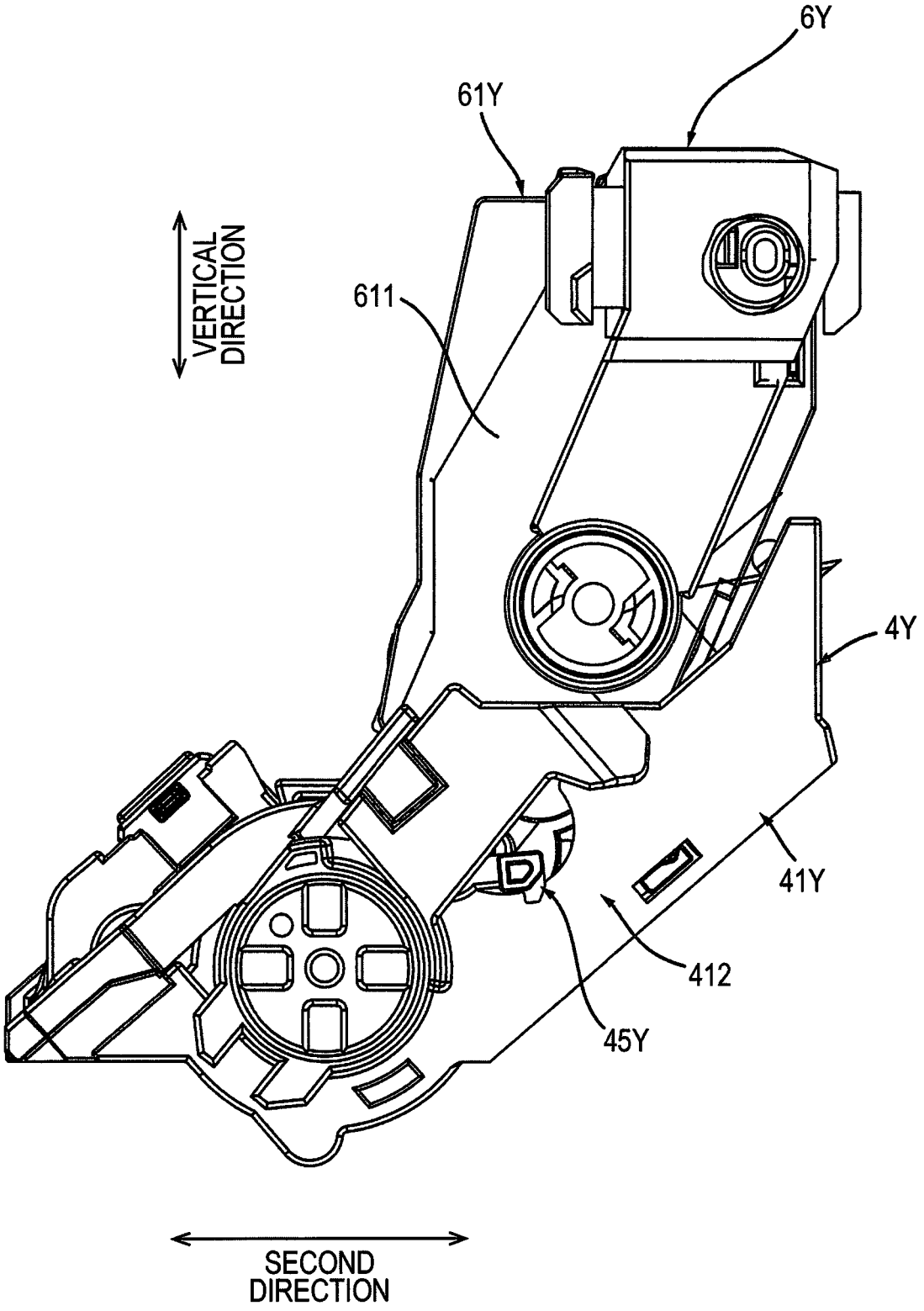
FIG. 4 is a side view the drum unit and the development unit shown in FIG. 1, as viewed from the other side.
Figure 5:
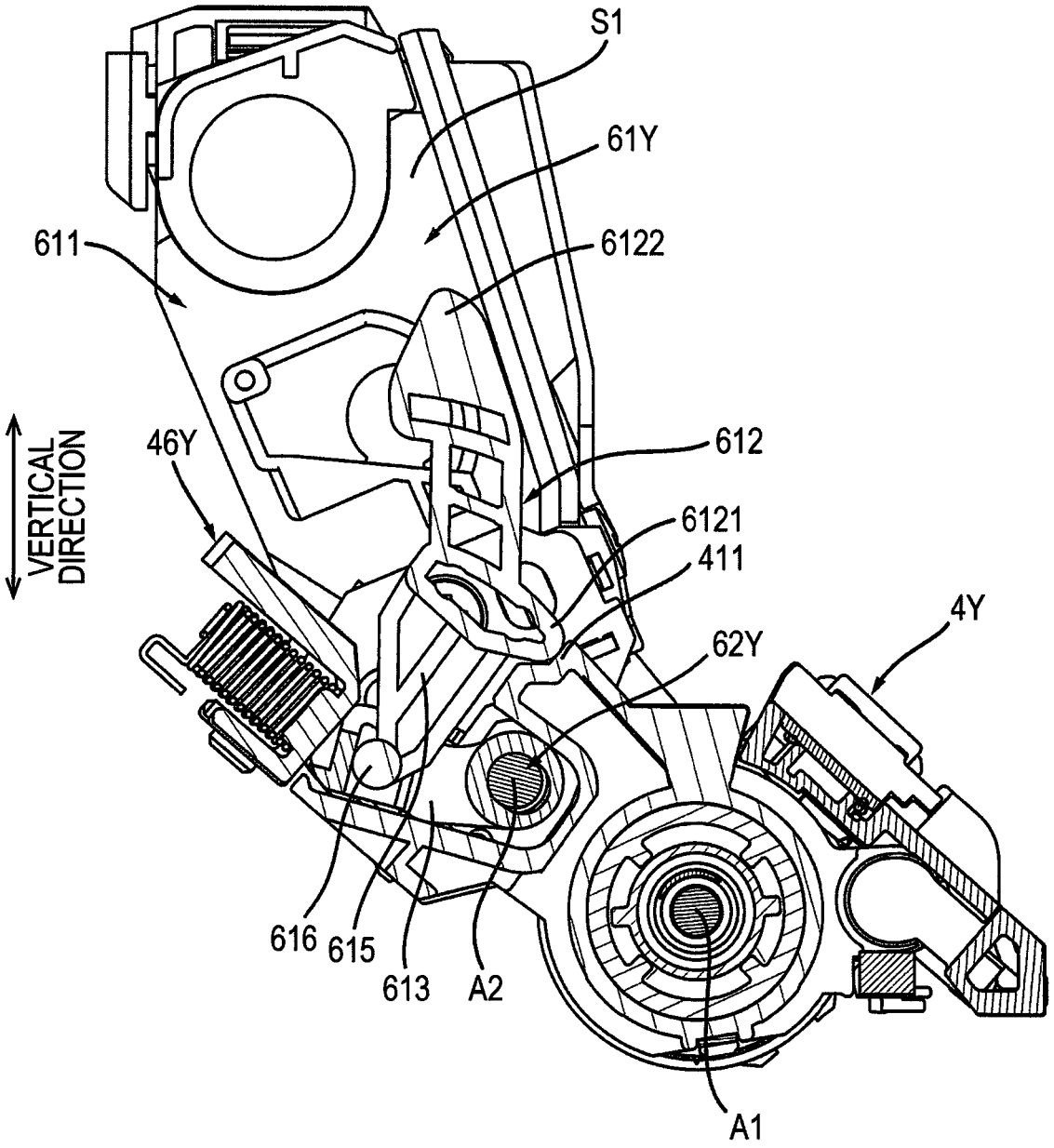
FIG. 5 is a side cross-sectional view of a first side wall and a second contact portion shown in FIG. 3, and shows a state where a development frame is located at the contact position.
Figure 6:
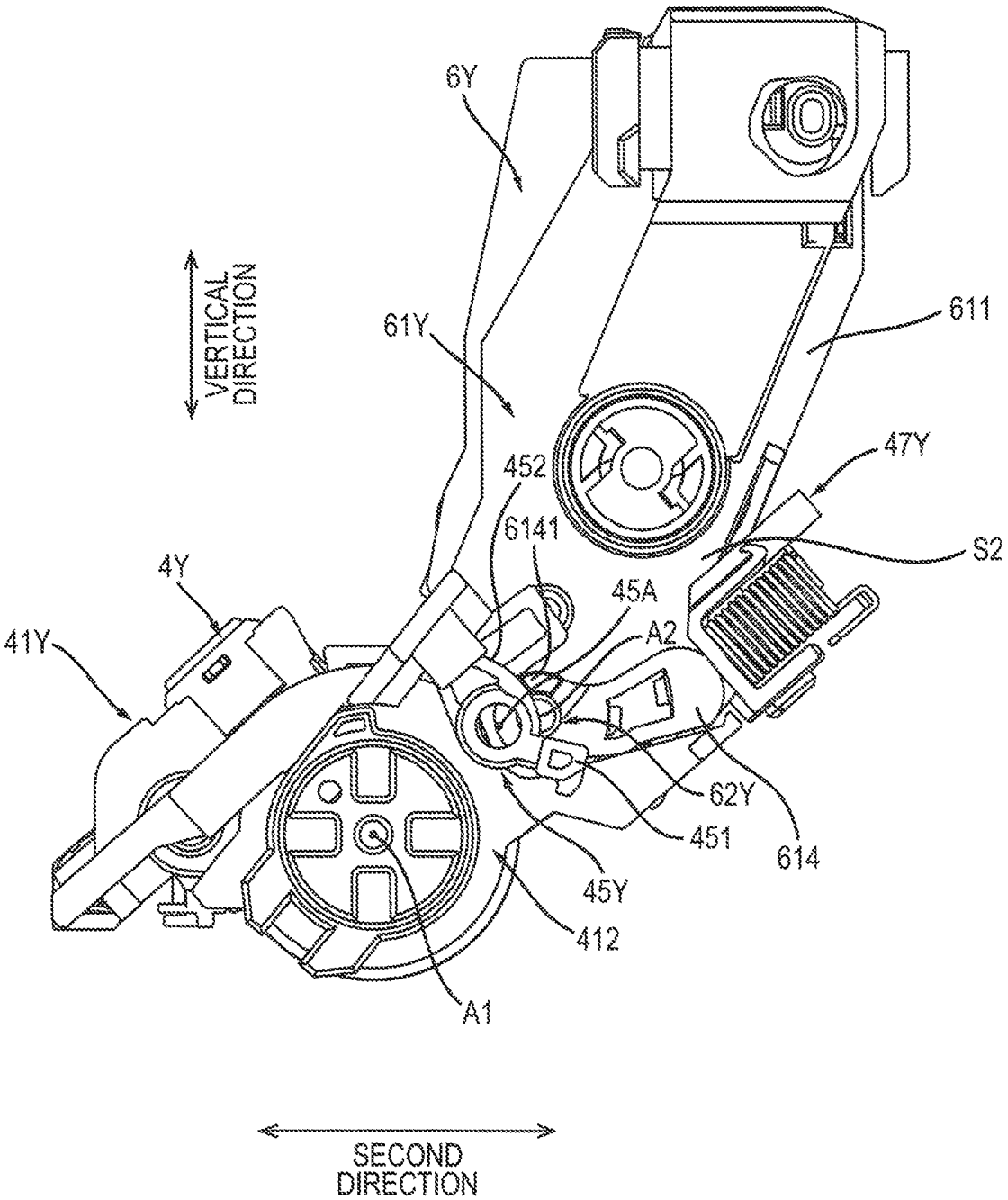
FIG. 6 is a side view of a rotating member and a second support portion shown in FIG. 4, and shows a state where the development frame is located at the contact position.

In addition to the drum frame 41Y, the photosensitive drum 42Y, and the charger 43Y, the drum unit 4Y includes a development electrode 44Y (see FIG. 3), a rotating member 45Y (see FIG. 4), and two pressing members 46Y and 47Y (see FIGS. 5 and 6).

2.1 Drum Frame 41Y

Figure 3:
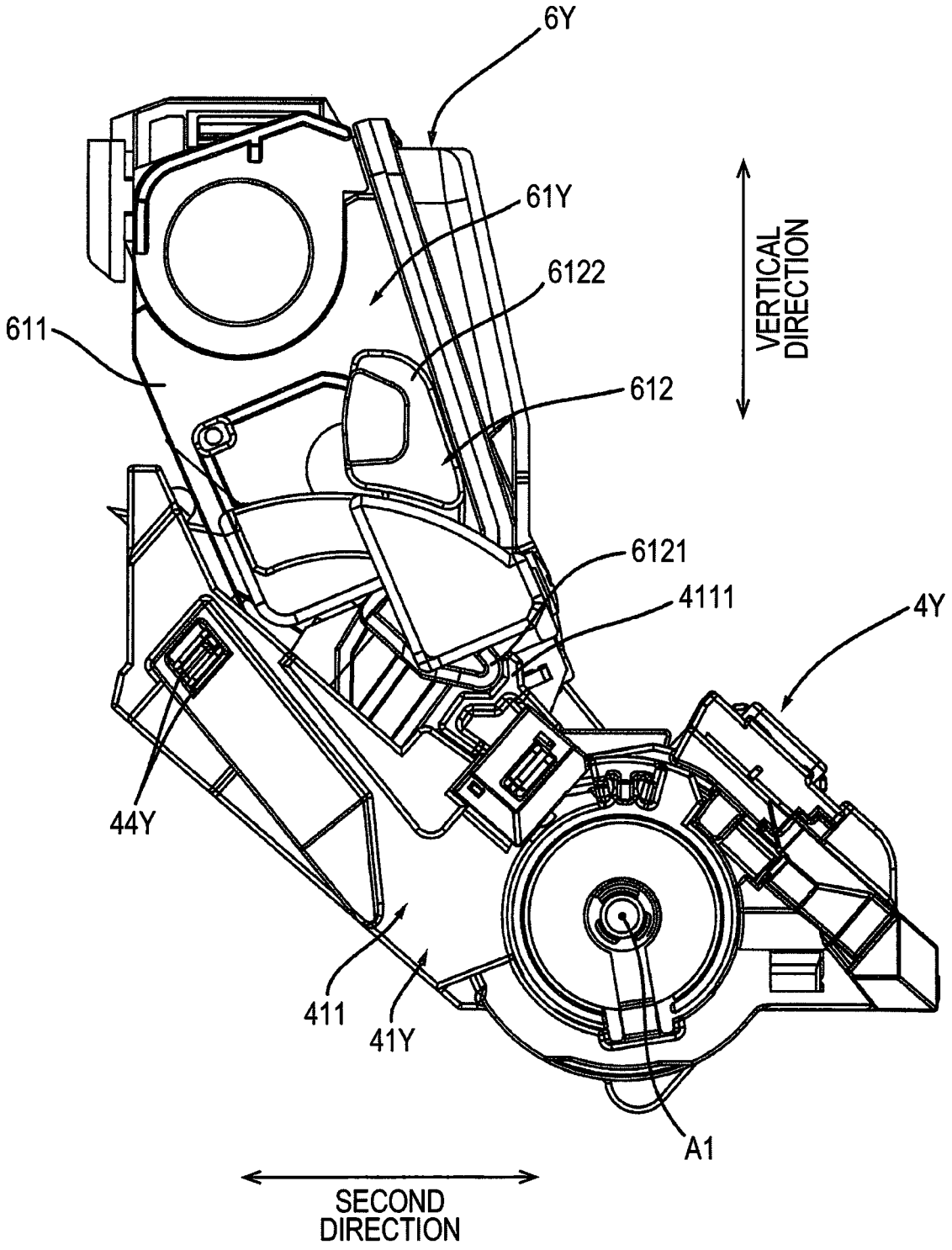
FIG. 3 is a side view of the drum unit and the development unit shown in FIG. 2A, as viewed from one side.

As shown in FIGS. 3 and 4, the drum frame 41Y includes a first side wall 411 (see FIG. 3) and a second side wall 412 (see FIG. 4).

2.1.1 First Side Wall 411

As shown in FIG. 3, the first side wall 411 is located at one end of the drum frame 41Y in the first direction. The first side wall 411 supports one end of the photosensitive drum 42Y (see FIG. 2A) in the first direction. The first side wall 411 includes a first contact portion 4111. In a state where the development frame 61Y is attached to the drum frame 41Y, the first contact portion 4111 is configured to contact a second contact portion 612 of the development frame 61Y. The second contact portion 612 will be described later.

The first contact portion 4111 is located away from the rotation axis A1 of the photosensitive drum 42Y in the radial direction of the photosensitive drum 42Y. In a state where the drum unit 4Y is located inside the housing 2, the first contact portion 4111 is located at a higher position than the rotation axis A1. The "higher" means "higher" (farther upward) in the direction of gravity when the image forming apparatus 1 is placed in an orientation in which it is intended to be used.

2.1.2 Second Side Wall 412

As shown in FIG. 4, the second side wall 412 is located at the other end of the drum frame 41Y in the first direction. The second side wall 412 is located away from the first side wall 411 in the first direction. The second side wall 412 supports the other end of the photosensitive drum 42Y (see FIG. 2A) in the first direction.

2.2 Development Electrode 44Y

As shown in FIG. 3, the development electrode 44Y is provided on the first side wall 411. In a state where the development frame 61Y is attached to the drum frame 41Y, the development electrode 44Y is electrically connected to the development roller 62Y (see FIG. 2A). In a state where the drum unit 4Y is located inside the housing 2, the development electrode 44Y is located at the opposite side of the rotation axis A1 of the photosensitive drum 42Y with respect to the first contact portion 4111 in the second direction. The second direction intersects the first direction and the vertical direction. In a state where the drum unit 4Y is located inside the housing 2, the development electrode 44Y is located at a higher position than the rotation axis A1 of the photosensitive drum 42Y.

In a state where the development frame 61Y is attached to the drum frame 41Y and the drum unit 4Y is located inside the housing 2, the development electrode 44Y is in contact with an electrode of the image forming apparatus 1. The electrode is not shown. The electrode contacts the development electrode 44Y in the first direction from the opposite side of the second side wall 412 (see FIG. 4). In a state where the electrode is in contact with the development electrode 44Y, the electrode presses the drum unit 4Y in the first direction. Thus, the drum unit 4Y is located in the housing 2 in the first direction.

2.3 Rotating Member 45Y

As shown in FIG. 4, the rotating member 45Y is supported by the second side wall 412. As shown in FIG. 6, the rotating member 45Y is rotatable about an axis 45A. The rotating member 45Y includes a third contact portion 451 and a fourth contact portion 452. In a state where the drum unit 4Y is located in the housing 2, the third contact portion 451 is configured to contact a lever 19Y. The lever 19Y will be described later. The fourth contact portion 452 is located at the opposite side of the third contact portion 451 with respect to the axis 45A. In a state where the third contact portion 451 is in contact with the lever 19Y, the fourth contact portion 452 contacts a protrusion 6141 of the development frame 61Y. The protrusion 6141 will be described later. Similarly, the drum unit 4M includes a rotating member 45M, the drum unit 4C includes a rotating member 45C, and the drum unit 4K includes a rotating member 45K (see FIG. 12).

2.4 Pressing Members 46Y and 47Y

As shown in FIGS. 5 and 6, in a state where the development frame 61Y is attached to the drum frame 41Y, the two pressing members 46Y and 47Y press the development frame 61Y toward the contact position (FIG. 2A). The two pressing members 46Y and 47Y are supported by the drum frame 41Y. The two pressing members 46Y and 47Y are located away from each other in the first direction.

3. Details of Development Frame 61Y

Next, the details of the development frame 61Y will be described with reference to FIGS. 3 to 6. The development frame 61M, 61C, and 61K are described in the same manner as the development frame 61Y. Thus, the descriptions of the development frame 61M, 61C, and 61K are omitted.

3.1 Development Frame 61Y

As shown in FIGS. 5 and 6, the development frame 61Y includes a development housing 611, a first support portion 613, the second contact portion 612, a connection portion 615, an engagement portion 616 (see FIG. 5), and a second support portion 614 (See FIG. 6).

The development housing 611 stores toner. The development housing 611 extends in the first direction. In a state where the development frame 61Y is attached to the drum frame 41Y, the development housing 611 is located between the first side wall 411 and the second side wall 412 in the first direction. The development housing 611 has a first side surface S1 and a second side surface S2. The first side surface S1 is located at one end of the development housing 611 in the first direction. The second side surface S2 is located at the other end of the development housing 611 in the first direction.

As shown in FIG. 5, the first support portion 613 supports one end of the development roller 62Y (see FIG. 2A) in the first direction. The first support portion 613 is aligned with the development housing 611 in the first direction. The first support portion 613 is located at the first side surface S1 of the development housing 611. The first support portion 613 is supported by the development housing 611. In a state where the development frame 61Y is attached to the drum frame 41Y, the first support portion 613 is located between the pressing member 46Y and the rotation axis A1 of the photosensitive drum 42Y. In a state where the development frame 61Y is attached to the drum frame 41Y, the first support portion 613 contacts the pressing member 46Y. Thus, the pressing member 46Y presses the development frame 61Y toward the contact position (see FIG. 2A).

The second contact portion 612 is aligned with the development housing 611 in the first direction. The second contact portion 612 is located at the first side surface S1 of the development housing 611. The second contact portion 612 is supported by the development housing 611. The second contact portion 612 is located above the first support portion 613 in a state where the development unit 6Y is located inside the housing 2. The second contact portion 612 extends in the vertical direction in a state where the development unit 6Y is located inside the housing 2. The second contact portion 612 has a first portion 6121 and a second portion 6122.

The first portion 6121 is located at one end of the second contact portion 612. In a state where the development frame 61Y is attached to the drum frame 41Y, the first portion 6121 contacts the first contact portion 4111. In a state where the development frame 61Y is attached to the drum frame 41Y, the first portion 6121 is located at the opposite side of the rotation axis A1 of the photosensitive drum 42Y with respect to the first contact portion 4111.

The second portion 6122 is located at the other end of the second contact portion 612. In a state where the development unit 6Y is located inside the housing 2, the second portion 6122 is located above the first portion 6121. In a state where the development unit 6Y is located inside the housing 2, the second portion 6122 is configured to contact a protrusion 183 of an arm 18Y. The protrusion 183 will be described later.

The engagement portion 616 engages the first support portion 613. The connection portion 615 connects the second contact portion 612 and the engagement portion 616.

As shown in FIG. 6, the second support portion 614 supports the other end of the development roller 62Y (see FIG. 2A) in the first direction. The second support portion 614 is located at the opposite side of the first support portion 613 with respect to the development housing 611 in the first direction. The second support portion 614 is located at the second side surface S2 of the development housing 611. The second support portion 614 is supported by the development housing 611. In a state where the development frame 61Y is attached to the drum frame 41Y, the second support portion 614 is located between the pressing member 47Y and the rotation axis A1 of the photosensitive drum 42Y. In a state where the development frame 61Y is attached to the drum frame 41Y, the second support portion 614 contacts the pressing member 47Y. Thus, the pressing member 47Y presses the development frame 61Y toward the contact position (see FIG. 2A).

The second support portion 614 includes a protrusion 6141. The protrusion 6141 extends (protrudes) in the first direction. In a state where the development frame 61Y is attached to the drum frame 41Y, the protrusion 6141 is located between the fourth contact portion 452 and the pressing member 47Y. In a state where the development frame 61Y is attached to the drum frame 41Y, the protrusion 6141 is configured to contact the fourth contact portion 452.

4. Details of Image Forming Apparatus

Next, the details of the image forming apparatus 1 will be described with reference to FIGS. 7 to 12.

Figure 7:
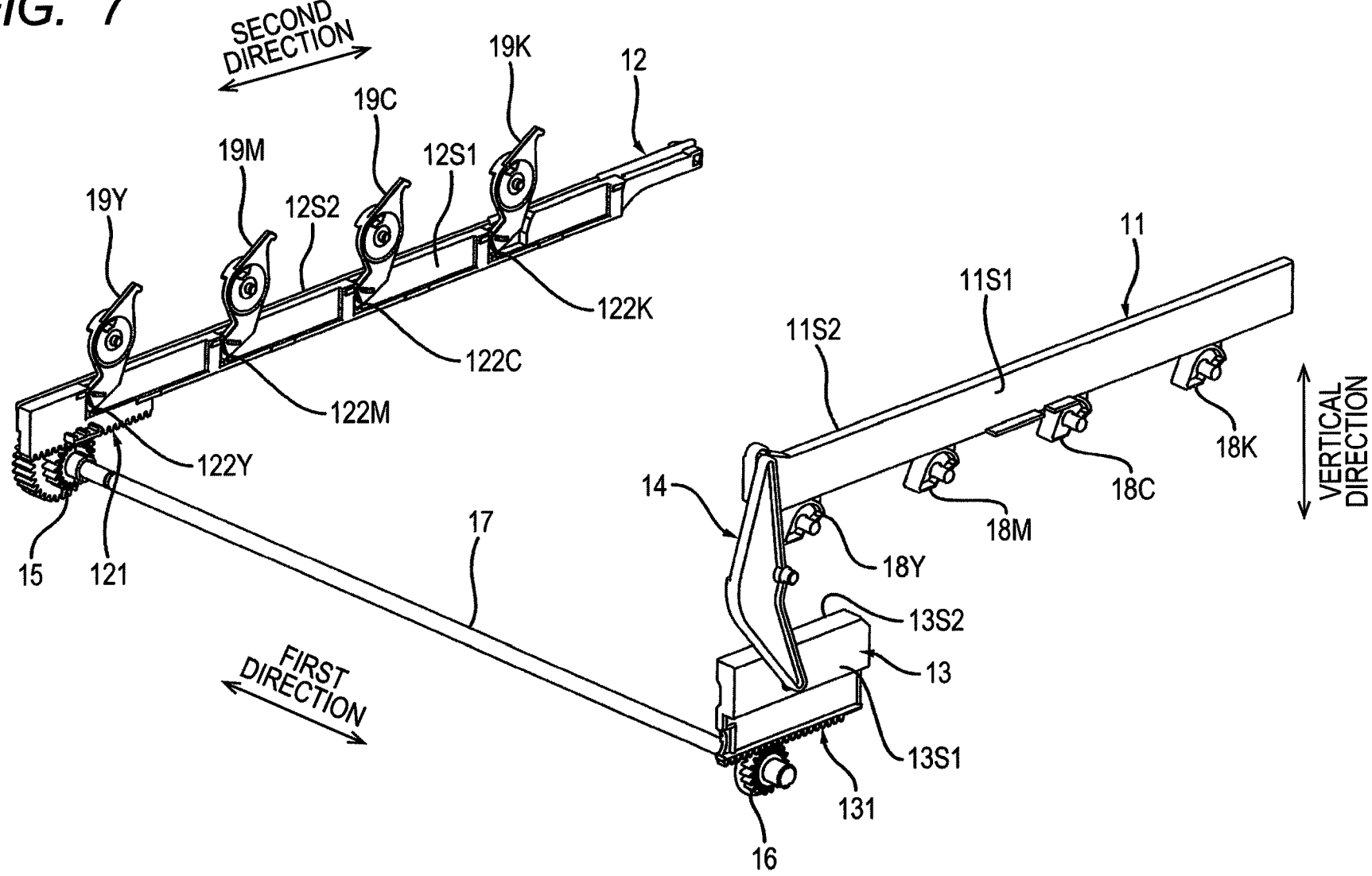
FIG. 7 is a perspective view of a first cam, a second cam, a link member, and a rotation rod included in the image forming apparatus shown in FIG. 1.

As shown in FIG. 7, the image forming apparatus 1 includes a first cam 11, four arms 18Y, 18M, 18C, and 18K, a second cam 12, four levers 19Y, 19M, 19C, and 19K, a link member 13, a rotation rod 14, a first gear 15, a second gear 16, and a shaft 17.

4.1 First Cam 11

Figure 8:
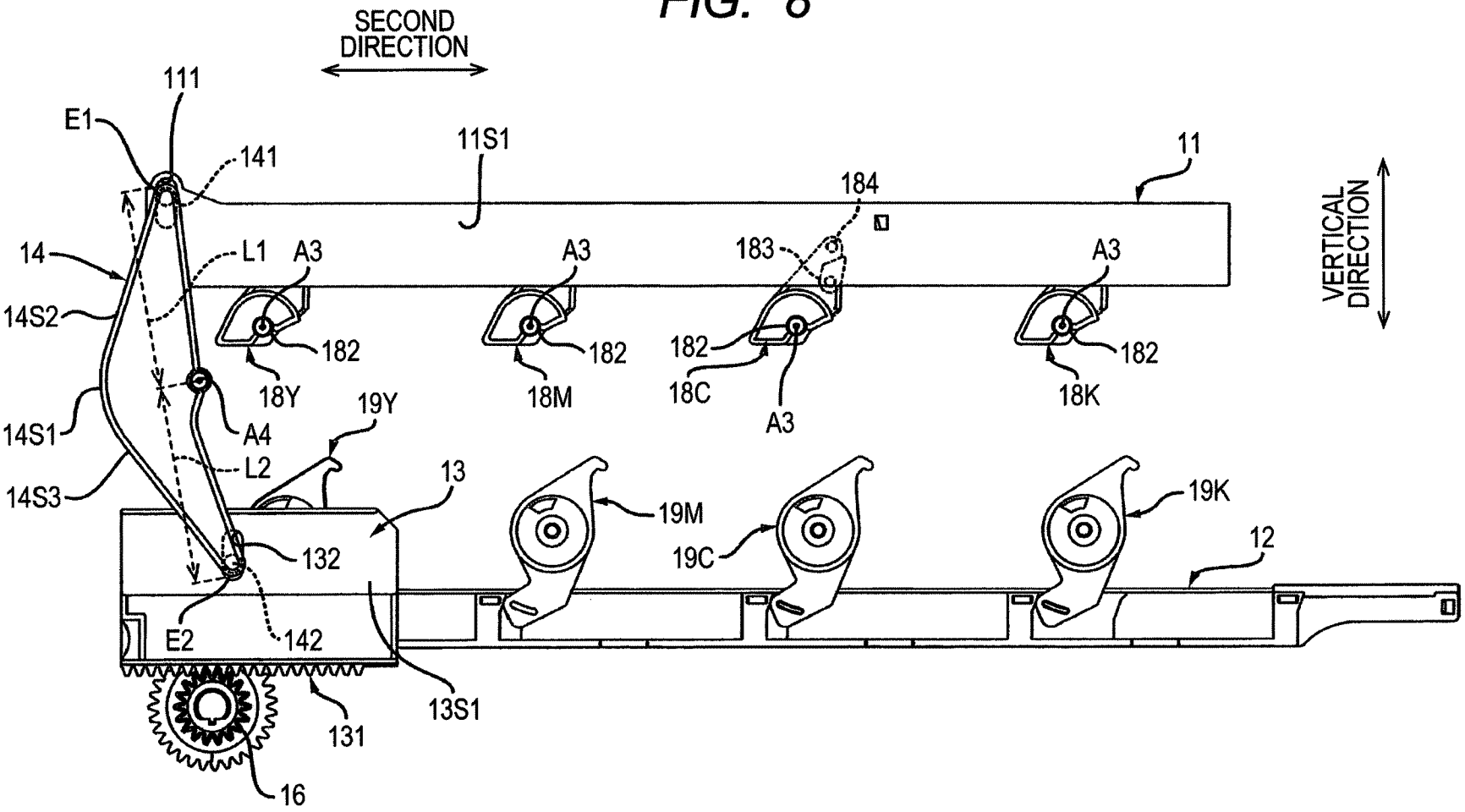
FIG. 8 is a side view of the first cam, the second cam, the link member, and the rotation rod shown in FIG. 7.

As shown in FIG. 8, the first cam 11 extends in the second direction. The first cam 11 is aligned with the four development frames 61Y, 61M, 61C, and 61K (see FIG. 1) in the first direction. The first cam 11 is arranged at a higher position than the second cam 12 in the vertical direction. The first cam 11 is located above the development electrode 44Y (see FIG. 3). The first cam 11 is located at the opposite side of the second cam 12 with respect to the development electrode 44Y (see FIG. 3) in the vertical direction.

Figure 9:
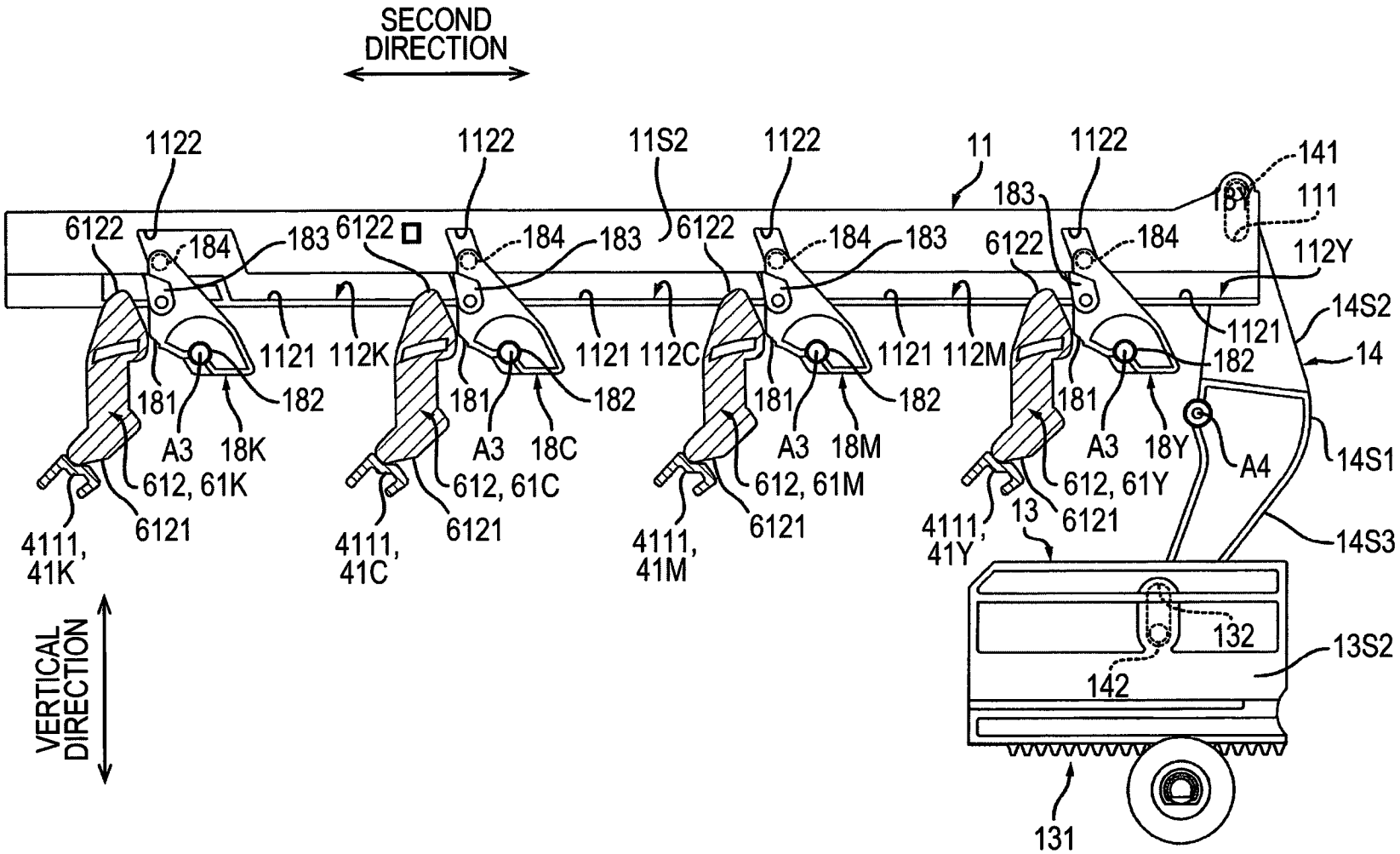
FIG. 9 is a side view of the first cam and the arm shown in FIG. 8, and shows a state where the first cam is located at a first position.
Figure 10:
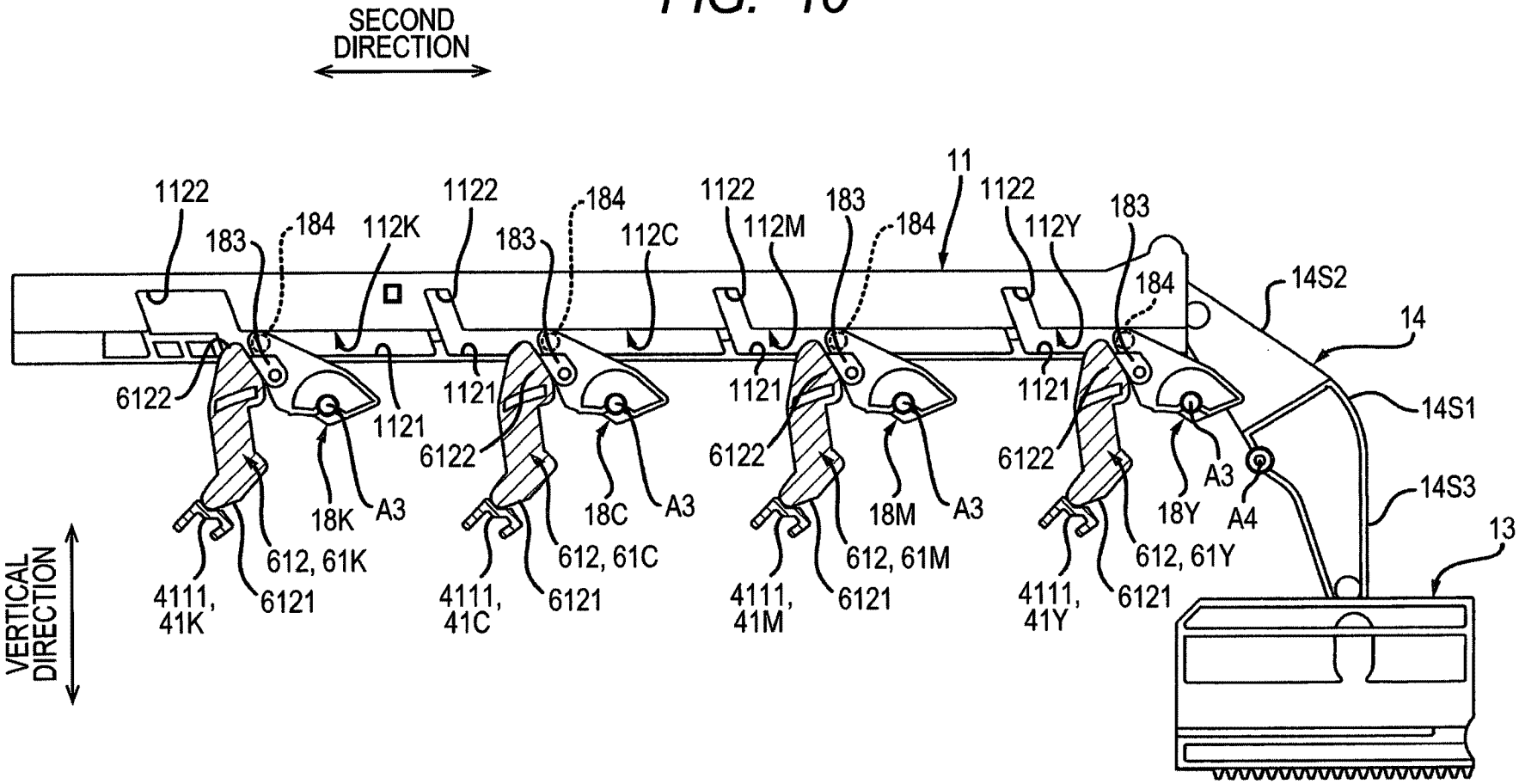
FIG. 10 is a side view of the first cam and the arm shown in FIG. 8, and shows a state where the first cam is located at a second position.

As shown in FIGS. 9 and 10, the first cam 11 is movable in the second direction between a first position (see FIG. 9) and a second position (see FIG. 10). In a state where the first cam 11 is located at the first position, the first cam 11 causes the four development frames 61Y, 61M, 61C, and 61K to be located at the contact positions (see FIG. 2A). In a state where the first cam 11 is located at the second position, the first cam 11 causes the four development frames 61Y, 61M, 61C, and 61K to be located at separation positions (see FIG. 2B).

Figure 11:
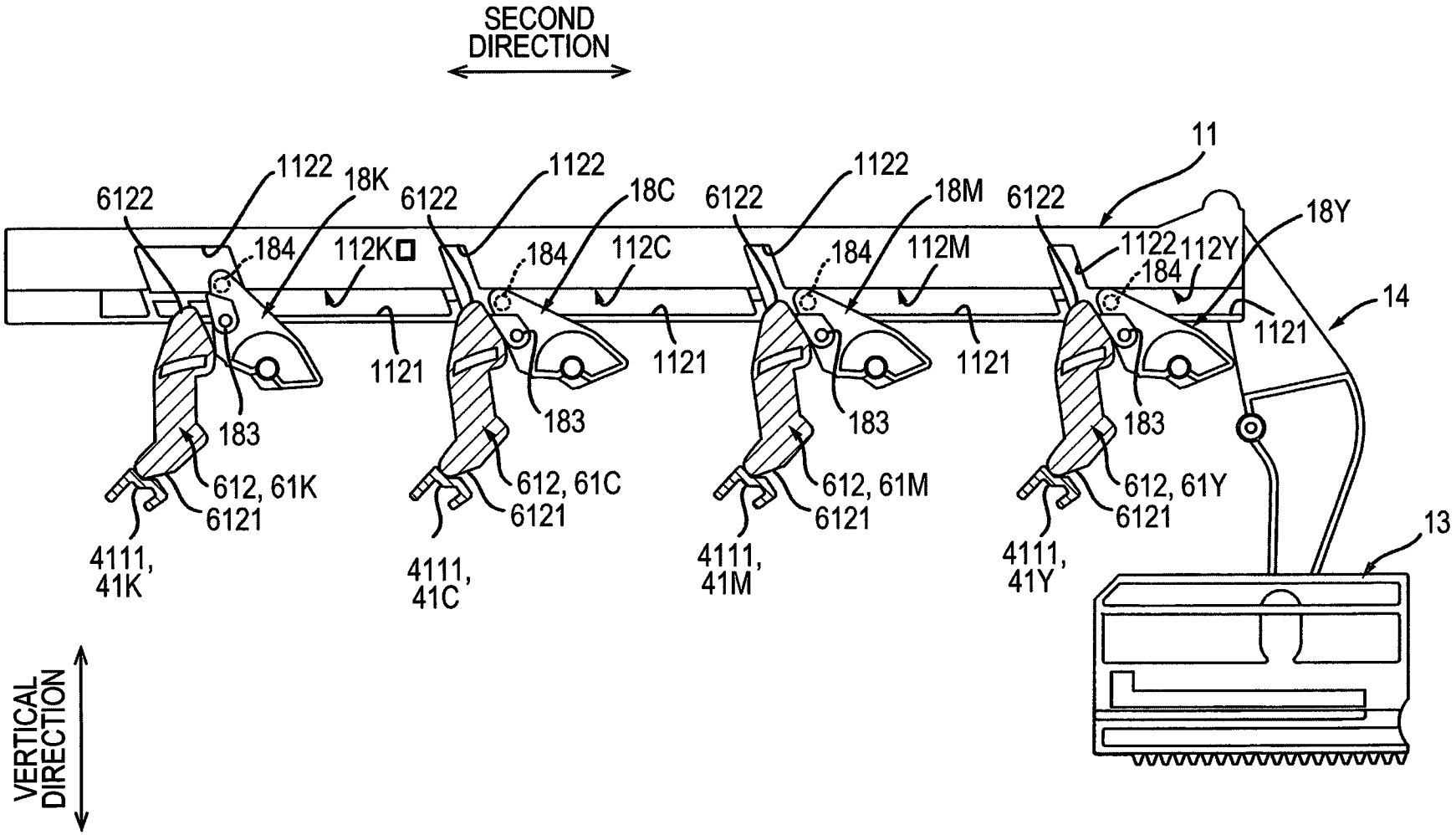
FIG. 11 is a side view of the first cam and the arm shown in FIG. 8, and shows a state where the first cam is located at a fifth position.

As shown in FIG. 11, the first cam 11 is located at the fifth position between the first position and the second position. In other words, the first cam 11 is movable between the first position, the fifth position, and the second position. In a state where the first cam 11 is located at the fifth position, the first cam 11 causes the development frame 61K to be located at the contact position (see FIG. 2A) and causes the three development frames 61Y, 61M, and 61C to be located at the separation positions (see FIG. 2B).

As shown in FIG. 7, the first cam 11 has a first surface 11S1 and a second surface 11S2 in the first direction. The first surface 11S1 is located at the opposite side of the development housing 611 of the development frame 61Y with respect to the second surface 11S2 in the first direction (see FIG. 3). The second surface 11S2 faces the development housing 611 of the development frame 61Y in the first direction (see FIG. 3).

As shown in FIG. 9, the first cam 11 has a first elongated hole 111 (see FIG. 8) and four first grooves 112Y, 112M, 112C, and 112K.

4.1.1 First Elongated Hole 111

A first boss 141 of the rotation rod 14 fits into the first elongated hole 111. The first boss 141 will be described later. The first elongated hole 111 is located at one end of the first surface 11S1 in the second direction (see FIG. 8). The first elongated hole 111 is recessed in the first direction from the first surface 11S1. The first elongated hole 111 extends in the vertical direction.

4.1.2 Four First Grooves 112Y, 112M, 112C, and 112K

Four first grooves 112Y, 112M, 112C, and 112K are located at the second surface 11S2. The four first grooves 112Y, 112M, 112C, and 112K are aligned in the second direction.

A boss 184 of the arm 18Y fits into the first groove 112Y. The boss 184 will be described later. The first groove 112Y is recessed in the first direction. The first groove 112Y has a first portion 1121 and a second portion 1122. The first portion 1121 of the first groove 112Y is located below the first elongated hole 111. The first portion 1121 extends in the second direction. The second portion 1122 is continuous with the first portion 1121. The second portion 1122 is located away from the first elongated hole 111 in the second direction. The second portion 1122 separates from the first elongated hole 111 in the second direction as it extends upward from the first portion 1121.

The first grooves 112M and 112C are described in the same manner as the first grooves 112Y. Therefore, the description of the first grooves 112M and 112C will be omitted. The boss 184 of the arm 18M fits into the first groove 112M. The boss 184 of the arm 18C fits into the first groove 112C. The first groove 112C is located at the opposite side of the first groove 112Y with respect to the first groove 112M in the second direction.

The boss 184 of the arm 18K fits into the first groove 112K. The first groove 112K is located at the opposite side of the first groove 112M with respect to the first groove 112C in the second direction. The first groove 112K has a first portion 1121 and a second portion 1122, similarly to the first groove 112Y. The length of the second portion 1122 of the first groove 112K in the second direction is larger than the length of the second portion 1122 of the first groove 112Y in the second direction.

4.2 Four Arms 18Y, 18M, 18C, and 18K

The four arms 18Y, 18M, 18C, and 18K are supported by the housing 2. The four arms 18Y, 18M, 18C, and 18K are located at intervals from each other in the second direction.

4.2.1 Arm 18Y

The arm 18Y is located between the first cam 11 and the development housing 611 of the development unit 6Y in the first direction (see FIG. 3). As shown in FIGS. 9 and 10, the arm 18Y is rotatable about an axis A3 between a first arm position (see FIG. 9) and a second arm position (see FIG. 10). The axis A3 extends in the first direction. The arm 18Y rotates in conjunction with the movement of the first cam 11. The arm 18Y is located at the first arm position in a state where the first cam 11 is located at the first position (see FIG. 9). The arm 18Y is located at the second arm position in a state where the first cam 11 is located at the second position (see FIG. 10). The arm 18Y is located at the second arm position in a state where the first cam 11 is located at the fifth position (see FIG. 11). The arm 18Y includes an arm body 181, a shaft 182, a boss 184, and the protrusion 183.

4.2.1.1 Arm Body 181

The arm body 181 supports the shaft 182, the boss 184, and the protrusion 183. In a state where the first cam 11 is located at the first position and the arm 18Y is located at the first arm position, the arm body 181 extends in the same direction as the second portion 1122 of the first groove 112Y. The arm body 181 has one end and the other end located away from the one end.

4.2.1.2 Shaft 182

The shaft 182 extends along the axis A3. The shaft 182 is provided at one end of the arm body 181. The shaft 182 is rotatably supported by the housing 2.

4.2.1.3 Boss 184

The boss 184 is provided at the other end of the arm body 181. The boss 184 protrudes from the arm body 181 toward the first cam 11. The boss 184 extends in the first direction. The boss 184 contacts the first cam 11. In other words, the arm 18Y contacts the first cam 11.

The boss 184 fits into the second portion 1122 in a state where the arm 18Y is located at the first arm position (see FIG. 9). In a state where the boss 184 is fitted in the second portion 1122, the boss 184 contacts the inner surface of the second portion 1122.

The boss 184 fits into the first portion 1121 in a state where the arm 18Y is located at the second arm position (see FIG. 10). In a state where the boss 184 is fitted in the first portion 1121, the boss 184 contacts the upper surface of the first portion 1121.

4.2.1.3 Protrusion 183

The protrusion 183 is located at the opposite side of the boss 184 with respect to the arm body 181 in the first direction. The protrusion 183 is located away from the axis A3 in the radial direction of the shaft 182. The protrusion 183 is located between one end and the other end of the arm body 181. The protrusion 183 protrudes from the arm body 181 toward the development housing 611. The protrusion 183 extends in the first direction. The protrusion 183 of the arm 18Y is located at the opposite side of the first contact portion 4111 of the drum frame 41Y with respect to the second contact portion 612 of the development frame 61Y.

In a state where the first cam 11 is located at the first position and the arm 18Y is located at the first arm position, the protrusion 183 of the arm 18Y is separated from the second portion 6122 of the second contact portion 612 of the development frame 61Y. In a state where the arm 18Y is located at the first arm position, the development frame 61Y is pressed by the two pressing members 46Y and 47Y and is located at the contact position (see FIG. 2A).

Figure 13:
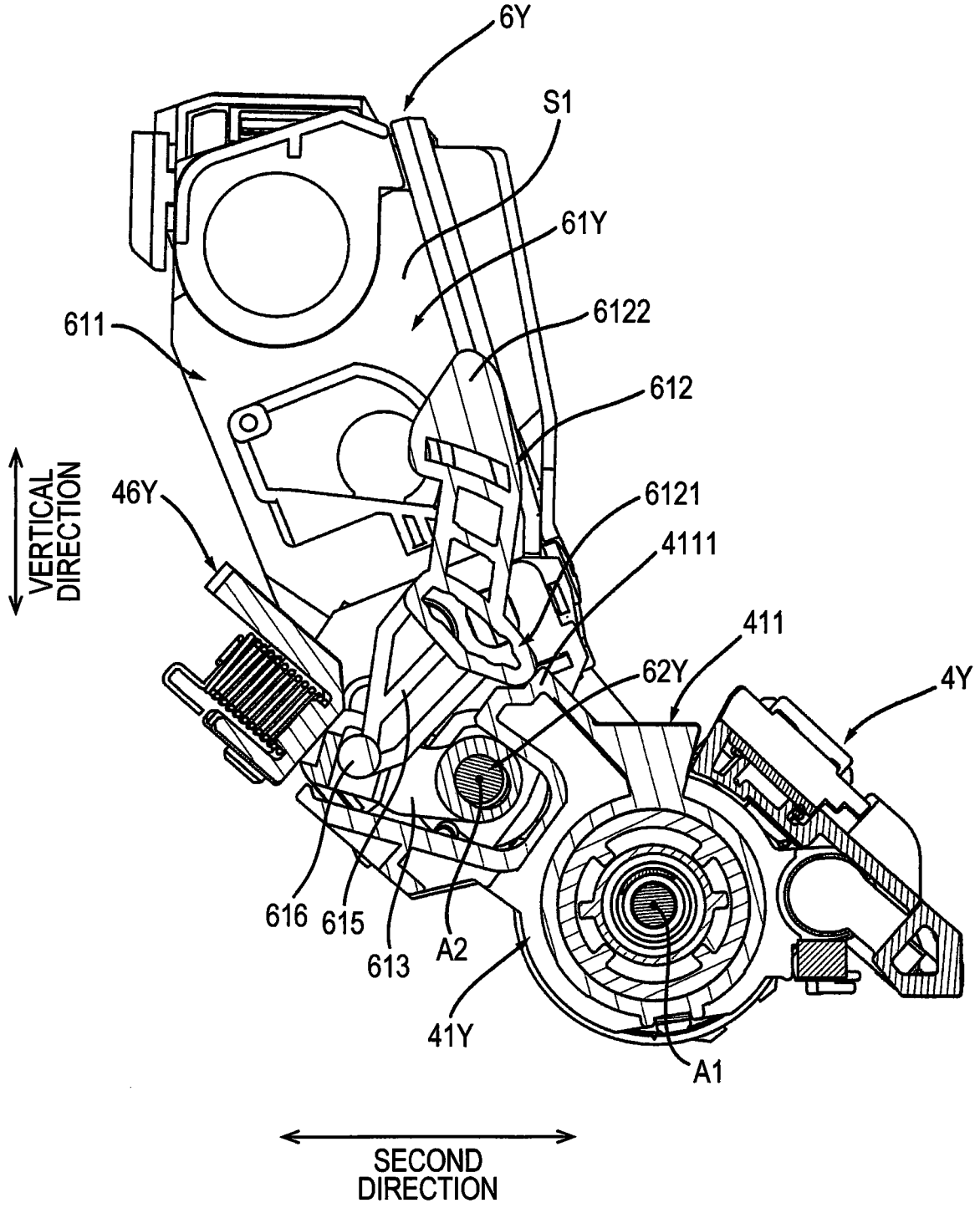
FIG. 13 is a side cross-sectional view of the first side wall and the second contact portion shown in FIG. 5, and shows a state where the development frame is located at the separation position.

As shown in FIG. 10, the protrusion 183 is located between the first cam 11 and the link member 13 in a state where the first cam 11 is located at the second position and the arm 18Y is located at the second arm position. In a state where the first cam 11 is located at the second position and the arm 18Y is located at the second arm position, the protrusion 183 of the arm 18Y contacts the second portion 6122 of the second contact portion 612 of the development frame 61Y. When the arm 18Y moves from the first arm position to the second arm position, the protrusion 183 of the arm 18Y presses the second portion 6122 of the second contact portion 612 of the development frame 61Y. Thus, as shown in FIG. 13, the development frame 61Y moves against the urging force of the two pressing members 46Y and 47Y from the contact position to the separation position around a contact portion between the first portion 6121 of the second contact portion 612 and the first contact portion 4111 as a fulcrum. More specifically, when the second contact portion 612 rotationally moves clockwise in FIG. 13 around the contact portion between the first portion 6121 and the first contact portion 4111, the connection portion 615 and the engagement portion 616 move upward and presses the first support portion 613 toward the pressing member 46Y. Then, the first support portion 613 presses the pressing member 46Y upward against the urging force of the coil spring of the pressing member 46Y. In this way, the development frame 61Y is located at the separation position (see FIG. 2B) in a state where the arm 18Y is located at the second arm position.

4.2.2 Arms 18M, 18C, and 18K

The arms 18M, 18C, and 18K have the same configuration as the arm 18Y. Therefore, the description of the configuration of the arms 18M, 18C, and 18K will be omitted.

As shown in FIG. 9, the arms 18M, 18C, and 18K are located at the first arm position in a state where the first cam 11 is located at the first position. As shown in FIG. 10, the arms 18M, 18C, and 18K are located at the second arm position in a state where the first cam 11 is located at the second position. As shown in FIG. 11, in a state where the first cam 11 is located at the fifth position, the arm 18K is located at the first arm position and the arms 18Y, 18M, 18C are located at the second arm position.

4.3 Second Cam 12

As shown in FIG. 7, the second cam 12 is located at a lower position than the first cam 11 in the vertical direction. The second cam 12 is located at the opposite side of the first cam 11 with respect to the four development frames 61Y, 61M, 61C, and 61K in the first direction (see FIG. 1). The second cam 12 is located away from the first cam 11 in the first direction.

The second cam 12 is movable in the second direction between the third position and the fourth position. The second cam 12 is located at the third position in a state where the first cam 11 is located at the first position. In a state where the first cam 11 is located at the first position and the second cam 12 located at the third position, the second cam 12 causes the four development frames 61Y, 61M, 61C, and 61K to be located at the contact position (see FIG. 2A) in cooperation with the first cam 11.

The second cam 12 is located at the fourth position in a state where the first cam 11 is located at the second position. In a state where the first cam 11 is located at the second position and the second cam 12 located at the fourth position, the second cam 12 causes the four development frames 61Y, 61M, 61C, and 61K to be located at the separation position in cooperation with the first cam 11 (see FIG. 2B).

When the first cam 11 moves from the first position to the second position, the second cam 12 moves from the third position to the fourth position. When the first cam 11 moves from the first position to the second position and the second cam 12 moves from the third position to the fourth position, the first cam 11 and the second cam 12 move in opposite directions in the second direction.

Figure 12:
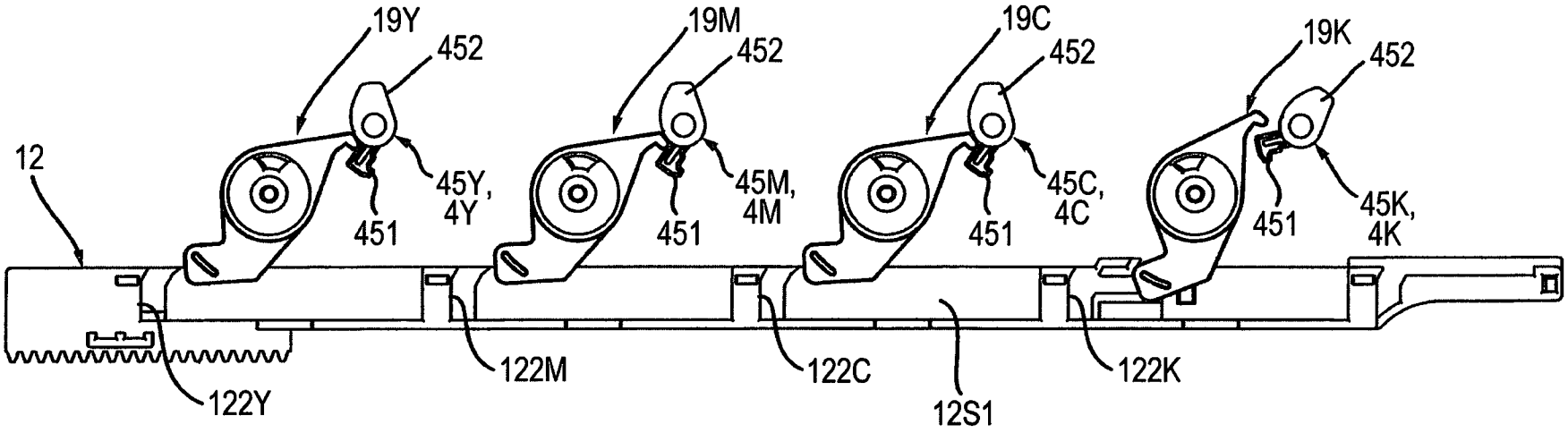
FIG. 12 is a side view of the second cam and a lever shown in FIG. 8, and shows a state where the second cam is located at a sixth position.

As shown in FIG. 12, the second cam 12 is located at the sixth position in a state where the first cam 11 is located at the fifth position. The second cam 12 is located at the sixth position between the third position and the fourth position. In other words, the second cam 12 is movable between the third position, the sixth position, and the fourth position. In a state where the first cam 11 is located at the fifth position and the second cam 12 located at the sixth position, the second cam 12 causes the development frame 61K to be located at the contact position (see FIG. 2A) and causes the three development frames 61Y, 61M, and 61C to be located at the separation positions (see FIG. 2B) in cooperation with the first cam 11.

As shown in FIG. 7, the second cam 12 has a first surface 12S1 and a second surface 12S2 in the first direction. The first surface 12S1 faces the link member 13 in the first direction. The second surface 12S2 is located at the opposite side of the first cam 11 with respect to the first surface 12S1 in the first direction.

The second cam 12 has a first rack gear 121. Further, the second cam 12 has four second grooves 122Y, 122M, 122C, and 122K.

4.3.1 First Rack Gear 121

The second cam 12 extends in the second direction. The second cam 12 has one end and the other end located away from the one end in the second direction. The first rack gear 121 is located at the lower surface at the one end of the second cam 12. The first rack gear 121 extends in the second direction. The first rack gear 121 has a plurality of gear teeth.

4.3.2 Second Grooves 122Y, 122M, 122C, and 122K

As shown in FIG. 12, the four second grooves 122Y, 122M, 122C, and 122K are located at the first surface 12S1. The four second grooves 122Y, 122M, 122C, and 122K are located at intervals from each other in the second direction.

The boss of the lever 19Y fits into the second groove 122Y. The boss is not shown. The second groove 122Y is recessed in the first direction. The second groove 122Y extends downward from the upper surface of the second cam 12.

The second grooves 122M and 122C are described in the same manner as the second grooves 122Y. Therefore, the description of the second grooves 122M and 122C will be omitted. The boss of the lever 19M fits into the second groove 122M. The boss of the lever 19C fits into the second groove 122C. The second groove 122C is located at the opposite side of the second groove 122Y with respect to the second groove 122M in the second direction.

The boss of the lever 19K fits into the second groove 122K. The second groove 122K is located at the opposite side of the second groove 122M with respect to the second groove 122C in the second direction. The second groove 122K is recessed in the first direction. The second groove 122K extends downward from the upper surface of the second cam 12. The length of the second groove 122K in the second direction is larger than the length of the second groove 122Y in the second direction.

4.4 Levers 19Y, 19M, 19C, and 19K

The four levers 19Y, 19M, 19C, and 19K are supported by the housing 2. The four levers 19Y, 19M, 19C, and 19K are located at intervals from each other in the second direction.

4.4.1 Lever 19Y

The lever 19Y is rotatable about an axis between a first lever position and a second lever position. The axis of the lever 19Y extends in the first direction. The lever 19Y rotates in conjunction with the movement of the second cam 12. The lever 19Y is located at the first lever position in a state where the second cam 12 is located at the third position. In a state where the lever 19Y is located at the first lever position, the lever 19Y is separated from the third contact portion 451 of the rotating member 45Y of the drum unit 4Y. As shown in FIG. 9, the arm 18Y is located at the first arm position and the lever 19Y is located at the first lever position in a state where the first cam 11 is located at the first position and the second cam 12 is located at the third position. In a state where the arm 18Y is located at the first arm position and the lever 19Y is located at the first lever position, the lever 19Y causes the development frame 61Y to be located at the contact position (see FIG. 2A) in cooperation with the arm 18Y.

Figure 14:
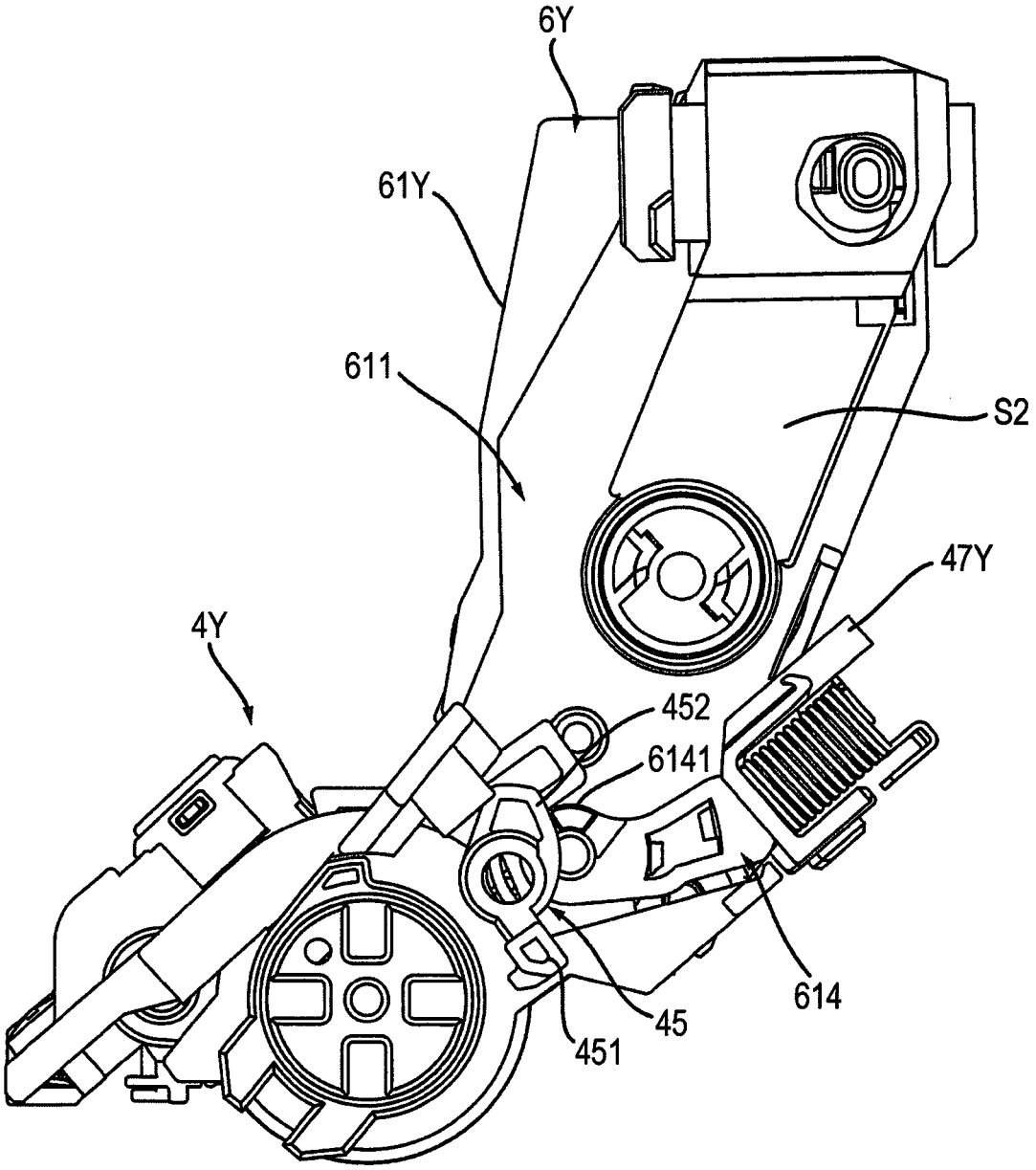
FIG. 14 is a side view of the rotating member and the second support portion shown in FIG. 6, and shows a state where the development frame is located at the separation position.

The lever 19Y is located at the second lever position in a state where the second cam 12 is located at the fourth position. In a state where the lever 19Y is located at the second lever position, the lever 19Y is in contact with the third contact portion 451 of the rotating member 45Y of the drum unit 4Y. As shown in FIG. 10, in a state where the first cam 11 is located at the second position and the second cam 12 is located at the fourth position, the arm 18Y is located at the second arm position and the lever 19Y is located at the second lever position. When the lever 19Y moves from the first lever position to the second lever position, the lever 19Y presses the third contact portion 451 of the rotating member 45Y in the drum unit 4Y. Then, as shown in FIG. 14, the rotating member 45Y rotates, and the fourth contact portion 452 contacts the protrusion 6141 of the second support portion 614. As a result, the development frame 61Y moves from the contact position to the separation position against the two pressing members 46Y and 47Y. Therefore, as shown in FIG. 10, the lever 19Y causes the development frame 61Y to be located at the separation position (see FIG.

2B) in cooperation with the arm 18Y in a state where the arm 18Y is located at the second arm position and the lever 19Y is located at the second lever position. Thus, the development frame 61Y can be located at the separation position in a stable manner.

4.4.2 Lever 19M, 19C, and 19K

The levers 19M, 19C, and 19K have the same configuration as the lever 19Y. Therefore, the description of the configuration of the levers 19M, 19C, and 19K will be omitted.

As shown in FIG. 7, the levers 19M, 19C, and 19K are located at the first lever position in a state where the second cam 12 is located at the third position. In a state where the first cam 11 is located at the first position and the second cam 12 is located at the third position, the four arms 18Y, 18M, 18C, and 18K are located at the first arm position and the four levers 19M, 19M, 19C and 19K are located at the first lever position. Therefore, the four development frames 61Y, 61M, 61C, and 61K are located at the contact positions (see FIG. 2A).

The levers 19M, 19C, and 19K are located at the second lever position in a state where the second cam 12 is located at the fourth position. In a state where the first cam 11 is located at the third position and the second cam 12 located at the fourth position, the four arms 18Y, 18M, 18C, and 18K are located at the second arm position, and the four levers 19M, 19M, 19C and 19K are located at the second lever position. Therefore, the four development frames 61Y, 61M, 61C, and 61K are located at the separation positions (see FIG. 2B).

As shown in FIG. 12, in a state where the second cam 12 is located at the sixth position, the lever 19K is located at the first lever position, and the levers 19Y, 19M and 19C are located at the second lever position. In a state where the first cam 11 is located at the fifth position and the second cam 12 is located at the sixth position, the arm 18K is located at the first arm position, the lever 19K is located at the first lever position, and the arms 18Y, 18M, and 18C are located at the second arm position, and the levers 19Y, 19M, and 19C are located at the second lever position. Therefore, the development frame 61K is located at the contact position (see FIG. 2A), and the development frames 61Y, 61M, and 61C are located at the separation positions (see FIG. 2B).

4.5 Link Member 13

As shown in FIG. 7, the link member 13 is located at the opposite side of the second cam 12 with respect to the four development frames 61Y, 61M, 61C, and 61K in the first direction. The link member 13 is located away from the second cam 12 in the first direction. The link member 13 is located below the first cam 11 in the vertical direction. The link member 13 moves in conjunction with the second cam 12.

The link member 13 has a first surface 13 S1 and a second surface 13 S2 in the first direction. The first surface 13 S1 is located at the opposite side of the second cam 12 with respect to the second surface 13 S2 in the first direction. The second surface 13 S2 faces the first surface 12S1 of the second cam 12 in the first direction. The link member 13 has a second rack gear 131. Further, the link member 13 has a second elongated hole 132 (see FIG. 8).

4.5.1 Second rack gear 131

The second rack gear 131 is located at the lower surface of the link member 13. The second rack gear 131 extends in the second direction. The second rack gear 131 includes a plurality of gear teeth. The number of gear teeth of the second rack gear 131 is the same as the number of gear teeth of the first rack gear 121. The gear tooth module of the second rack gear 131 is the same as the gear tooth module of the first rack gear 121.

4.5.2 Second Elongated Hole 132

As shown in FIG. 8, a second boss 142 of the rotation rod 14 fits into the second elongated hole 132. The second boss 142 will be described later. The second elongated hole 132 is located at the first surface 13 S1 of the link member 13. The second elongated hole 132 extends in the vertical direction.

4.6 Rotation rod 14

The rotation rod 14 connects the first cam 11 and the link member 13. The rotation rod 14 is supported by the housing 2. The rotation rod 14 is rotatable about an axis A4. The axis A4 extends in the first direction. With this configuration, the movement of the first cam 11 and the movement of the link member 13 are linked. Further, the movement of the first cam 11 and the movement of the second cam 12 are linked. Further, since the rotation rod 14 connects the first cam 11 and the link member 13, the difference between the movement timing of the first cam 11 and the movement timing of the link member 13 can be suppressed as compared with the case where a plurality of gears connect the first cam 11 and the link member 13.

The rotation rod 14 is located at the opposite side of the second cam 12 with respect to the first cam 11 in the first direction. The axis A4 of the rotation rod 14 is located at the opposite side of the arm 18M with respect to the axis A3 of the arm 18Y in the second direction. The rotation rod 14 includes one end E1 and an other end E2. The one end E1 of the rotation rod 14 is located above the other end E2 of the rotation rod 14. The one end E1 of the rotation rod 14 is connected to one end of the first cam 11 in the second direction. The other end E2 of the rotation rod 14 is located at the opposite side of the one end E1 with respect to the axis A4. The other end E2 of the rotation rod 14 is connected to the link member 13. A length L1 between the one end E1 of the rotation rod 14 and the axis A4 is the same as a length L2 between the other end E2 of the rotation rod 14 and the axis A4. Therefore, when the rotation rod 14 rotates, the moving amount of the link member 13 and the moving amount of the first cam 11 are equal to each other.

The rotation rod 14 includes the first boss 141 and the second boss 142. The rotation rod 14 has an arcuate surface 14S1, a first surface 14S2, and a second surface 14S3.

4.6.1 First Boss 141

The first boss 141 is arranged at the one end E1 of the rotation rod 14. The first boss 141 protrudes from the one end E1. The first boss 141 extends in the first direction. The first boss 141 fits into the first elongated hole 111. Thus, the one end E1 of the rotation rod 14 is connected to the first cam 11. In a state where the first boss 141 is fitted into the first elongated hole 111, the first elongated hole 111 has play in the vertical direction.

4.6.2 Second Boss 142

The second boss 142 is arranged at the other end E2 of the rotation rod 14. The second boss 142 protrudes from the other end E2. The second boss 142 extends in the first direction. The second boss 142 fits into the second elongated hole 132. Thus, the other end E2 of the rotation rod 14 is connected to the link member 13. In a state where the second boss 142 is fitted into the second elongated hole 132, the second elongated hole 132 has play in the vertical direction. Therefore, when the first cam 11 moves between the first position and the second position, the rotation rod 14 rotates smoothly.

4.6.3 Arcuate Surface 14S1, First Surface 14S2, Second Surface 14S3

The rotation rod 14 has a triangular shape when viewed from the first direction. The arcuate surface 14S1 extends along the rotation direction of the rotation rod 14. The arcuate surface 14S1 is located away from the axis A4 in the second direction. The arcuate surface 14S1 is located at the opposite side of the axis A3 of the arm 18Y with respect to the axis A4 in the second direction. The first surface 14S2 connects the arcuate surface 14S1 and the one end E1 of the rotation rod 14. The first surface 14S2 extends in a direction intersecting the vertical direction. The first surface 14S2 approaches the axis A3 of the arm 18Y in the second direction as it advances from the arcuate surface 14S1 toward the one end E1. The second surface 14S3 connects the arcuate surface 14S1 and the other end E2 of the rotation rod 14. In a state where the first cam 11 is located at the first position, the second surface 14S3 extends in a direction intersecting the vertical direction. The second surface 14S3 approaches the lever 19Y in the second direction as it advances from the arcuate surface 14S1 toward the other end E2. As shown in FIG. 10, the second surface 14S3 extends in the vertical direction in a state where the first cam 11 is located at the second position and the second cam 12 is located at the fourth position. Therefore, it is possible to reduce the space required for the rotation of the rotation rod 14 while ensuring the rigidity of the rotation rod 14.

4.7 First Gear 15

As shown in FIG. 7, the driving force from a motor is input to the first gear 15. The motor is not shown. The first gear 15 transmits a driving force to the second cam 12. The first gear 15 is a pinion gear that meshes with the first rack gear 121. The first gear 15 has a plurality of gear teeth.

4.8 Second Gear 16

The second gear 16 transmits a driving force to the link member 13. The second gear 16 is a pinion gear that meshes with the second rack gear 131. The second gear 16 has a plurality of gear teeth. The number of gear teeth of the second gear 16 is the same as the number of gear teeth of the first gear 15. The gear tooth module of the second gear 16 is the same as the gear tooth module of the first gear 15.

4.9 Shaft 17

The shaft 17 connects the first gear 15 and the second gear 16. The shaft 17 extends in the first direction. The shaft 17 has one end and the other end located away from the one end in the first direction. The first gear 15 is attached to the one end of the shaft 17. The second gear 16 is attached to the other end of the shaft 17.

With this configuration, when the first gear 15 transmits the driving force to the second cam 12, the second gear 16 transmits the driving force to the link member 13. Therefore, when the second cam 12 moves, the link member 13 moves. Then, the rotation rod 14 rotates as the link member 13 moves. Then, the first cam 11 moves as the rotation rod 14 rotates. As a result, the first cam 11 and the second cam 12 are synchronized.

5. Movement of First Cam 11 and Second Cam 12

Next, the movement of the first cam 11 and the second cam 12 will be described with reference to FIGS. 7 to 14. Specifically, a case where the first cam 11 moves from the first position through the fifth position to the second position and the second cam 12 moves from the third position through the sixth position to the fourth position will be described.

As shown in FIG. 7, in a state where the first cam 11 is located at the first position and the second cam 12 is located at the third position, all of the four arms 18Y, 18M, 18C, and 18K are located at the first arm position, and all of the four levers 19Y, 19M, 19C, and 19K are located at the first lever position. Therefore, all the development frames 61Y, 61M, 61C, and 61K are located at the contact positions (see FIG. 2A).

When the driving force from the motor is input to the first gear 15, the first gear 15 and the second gear 16 rotate at the same time. Then, the second cam 12 and the link member 13 move at the same time.

The second cam 12 moves from the third position to the sixth position. At this time, as shown in FIG. 12, the three levers 19Y, 19M, and 19C rotate from the first lever position to the second lever position. On the other hand, the lever 19K is maintained at the first lever position.

As shown in FIG. 11, when the link member 13 moves, the rotation rod 14 rotates. At this time, the first cam 11 moves from the first position to the fifth position. Then, the three arms 18Y, 18M, and 18C rotate from the first arm position toward the second arm position. On the other hand, the arm 18K is maintained at the first arm position.

Thus, the movement of the first cam 11 from the first position to the fifth position and the movement of the second cam 12 from the third position to the sixth position are synchronized, the three development frames 61Y, 61M, and 61C move from the contact position to the separation position, and the development frame 61K is maintained at the contact position.

After that, as shown in FIG. 10, the second cam 12 moves from the sixth position to the fourth position, and the first cam 11 moves from the fifth position to the second position. Then, the lever 19K rotates from the first lever position to the second lever position, and the arm 18K rotates from the first arm position to the second arm position.

As described above, the movement of the first cam 11 from the first position to the second position and the movement of the second cam 12 from the third position to the fourth position are synchronized, and the four development frames 61Y, 61M, 61C, and 61K move from the contact position to the separation position (see FIGS. 2A and 2B).

6. Operations and Effects

As shown in FIGS. 7 and 8, in the image forming apparatus 1, the first cam 11 and the second cam 12 are arranged at different positions in the vertical direction. Thus, as compared with the case where the first cam 11 and the second cam 12 are arranged at the same position in the vertical direction, the degree of freedom in the arrangement of the first cam 11 and the second cam 12 can be improved.

As a result, even if the image forming apparatus 1 is downsized, the first cam 11 and the second cam 12 can be arranged. Thus, the four development frames 61Y, 61M, 61C, and 61K can be smoothly moved to the contact position and the separation position while downsizing the image forming apparatus 1.

In particular, in the image forming apparatus 1, the first cam 11 is located at the opposite side of the second cam 12 with respect to the development electrode 44. Thus, the electrode of the image forming apparatus 1 contacts the development electrode 44 from the opposite side of the second side wall 412 in the first direction. As a result, in a state where the electrode of the image forming apparatus 1 is in contact with the development electrode 44, the electrode presses the drum unit 4 in the first direction. Thus, the drum unit 4 and the development unit 6 can be positioned relative to the housing 2 in the first direction.

7. Modification

While the disclosure has been described in detail with reference to the above aspects thereof, it would be apparent to those skilled in the art that various changes and modifications may be made therein without departing from the scope of the claims.

Figure 15:
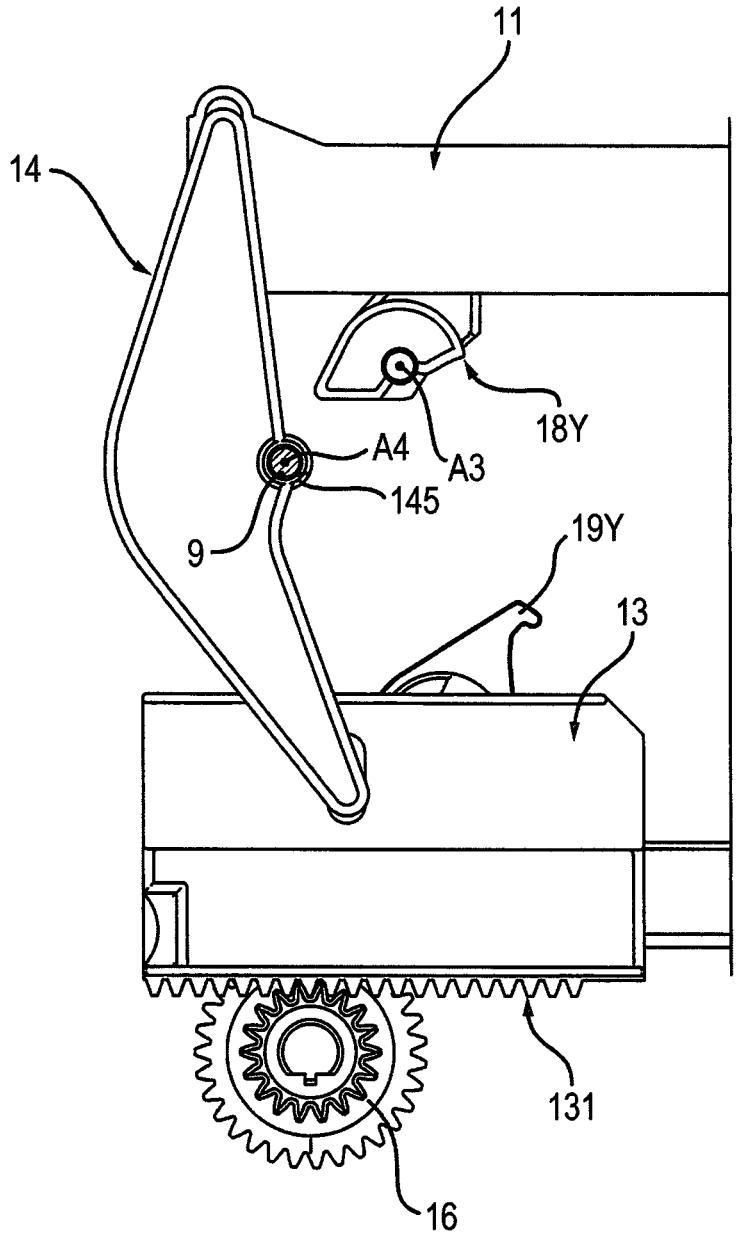
FIG. 15 is a side view of a modification of the rotation rod shown in FIG. 8.

A modification of the rotation rod 14 will be described with reference to FIG. 15. In the modification, the same members as those in the above-described embodiment are designated by the same reference numerals, and the description thereof will be omitted.

The rotation rod 14 has a hole 145. The hole 145 is formed to penetrate the rotation rod 14 along an axis A4. The image forming apparatus 1 includes an electrode 9. The electrode 9 is arranged in the hole 145. The electrode 9 contacts the development electrode 44Y of the drum unit 4Y. The development electrode 44Y is not shown. With this configuration, the electrode 9 is electrically connected to the development roller 62Y through the development electrode 44Y.

Further, the development frame 61 supporting the development roller 62 and the drum frame 41 supporting the photosensitive drum 42 may be integrally formed as a process unit.

In these modifications, the operations and effects similar to those of the above-described embodiment can be obtained.

What is claimed is:

1. An image forming apparatus comprising:

a drum frame supporting a photosensitive drum rotatable about a rotation axis extending in a first direction;

a development frame supporting a development roller, the development frame being movable between a contact position at which the development roller contacts the photosensitive drum and a separation position at which the development roller is separated from the photosensitive drum;

a first cam movable between:

a first position at which the first cam causes the development frame to be located at the contact position; and a second position at which the first cam causes the development frame to be located at the separation position; and a second cam located at an opposite side of the first cam with respect to the development frame in the first direction, the second cam being movable between:

a third position at which the second cam, in cooperation with the first cam, causes the development frame to be located at the contact position in a state where the first cam is located at the first position; and a fourth position at which the second cam, in cooperation with the first cam, causes the development frame to be located at the separation position in a state where the first cam is located at the second position, the first cam being located at a higher position than the second cam in a vertical direction.

2. The image forming apparatus according to claim 1, further comprising:

a link member located at an opposite side of the second cam with respect to the development frame in the first direction, the link member being movable in conjunction with the second cam, the link member being located below the first cam in the vertical direction; and a rotation rod connecting the first cam with the link member, the rotation rod being rotationally movable about an axis extending in the first direction.

3. The image forming apparatus according to claim 2, further comprising:

a first gear configured to transmit a driving force to the second cam;

a second gear configured to transmit a driving force to the link member; and a shaft connecting the first gear with the second gear.

4. The image forming apparatus according to claim 3, further comprising an electrode electrically connected with the development roller, wherein the rotation rod has a hole formed to penetrate the rotation rod along the axis, and the electrode is disposed in the hole.

5. The image forming apparatus according to claim 2, wherein the rotation rod has one end and an other end located at an opposite side of the one end with respect to the axis, the one end being connected with the first cam, the other end being connected with the link member; and wherein a length between the one end and the axis is same as a length between the other end and the axis.

6. The image forming apparatus according to claim 5, wherein the rotation rod includes a first boss located at the one end and a second boss located at the other end;

wherein the first cam has a first elongated hole in which the first boss fits, the first elongated hole extending in the vertical direction; and wherein the link member has a second elongated hole in which the second boss fits, the second elongated hole extending in the vertical direction.

7. The image forming apparatus according to claim 5, wherein the rotation rod includes:

an arcuate surface extending along a rotational direction of the rotation rod, the arcuate surface located away from the axis in a second direction intersecting the first direction and the vertical direction;

a first surface connecting the arcuate surface with the one end; and a second surface connecting the arcuate surface with the other end, the second surface extending in the vertical direction in a state where the first cam is located at the second position.

8. The image forming apparatus according to claim 2, further comprising:

a first gear configured to transmit a driving force to the second cam;

a second gear configured to transmit a driving force to the link member; and a shaft connecting the first gear with the second gear, wherein the rotation rod has one end and an other end located at an opposite side of the one end with respect to the axis, the one end being connected with the first cam, the other end being connected with the link member; and wherein, when the first cam moves from the first position to the second position and the second cam moves from the third position to the fourth position, the first cam and the second cam move in opposite directions.

9. The image forming apparatus according to claim 1, further comprising an arm in contact with the first cam, wherein the arm includes a protrusion in contact with the development frame in a state where the first cam is located at the second position.

10. The image forming apparatus according to claim 9, wherein, in a state where the first cam is located at the second position, the protrusion is located between the first cam and the link member in the vertical direction.

11. The image forming apparatus according to claim 1, wherein the development frame is attachable to and detachable from the drum frame.

12. The image forming apparatus according to claim 1, further comprising:

a main housing;

a pressing member supported by the drum frame, the pressing member being configured to press the development frame toward the contact position;

a contact portion supported by the development frame;

an arm rotatably supported by the main housing, the arm being configured to, when the first cam moves from the first position to the second position, press the contact portion such that the development frame moves from the contact position toward the separation position against an urging force of the pressing member;

a rotating member rotatably supported by the drum frame; and a lever rotatably supported by the main housing, the lever being configured to, when the second cam moves from the third position to the fourth position, press the rotating member such that the rotating member presses the development frame toward the separation position against the urging force of the pressing member.

13. The image forming apparatus according to claim 1, wherein the drum frame comprises a first drum frame and a second drum frame;

wherein the first cam is movable between the first position and the second position in a second direction where the first drum frame and the second drum frame are arranged; and wherein the second cam is movable between the third position and the fourth position in the second direction.

14. An image forming apparatus comprising:

a drum frame supporting a photosensitive drum rotatable about a rotation axis extending in a first direction;

a development frame supporting a development roller, the development frame being movable between a contact position at which the development roller contacts the photosensitive drum and a separation position at which the development roller is separated from the photosensitive drum;

a first cam configured to move the development frame between the contact position and the separation position; and a second cam located at an opposite side of the first cam with respect to the development frame in the first direction, the second cam being configured to move the development frame between the contact position and the separation position in cooperation with the first cam, wherein the first cam is located at a higher position than the second cam in a vertical direction.

* * * * *